US009247770B2

(12) United States Patent
Barnes et al.

(10) Patent No.: US 9,247,770 B2
(45) Date of Patent: Feb. 2, 2016

(54) METHOD OF FORMING A ROD FOR USE IN THE MANUFACTURE OF CIGARETTE FILTERS

(75) Inventors: Vernon Brent Barnes, Advance, NC (US); Robert William Benford, Kernersville, NC (US); Timothy Frederick Thomas, High Point, NC (US); Stephen Thomas Matthews, Clemmons, NC (US); John Larkin Nelson, Lewisville, NC (US); Travis Eugene Howard, Clemmons, NC (US)

(73) Assignee: R.J. REYNOLDS TOBACCO COMPANY, Winston-Salem, NC (US)

( * ) Notice: Subject to any disclaimer, the term of this patent is extended or adjusted under 35 U.S.C. 154(b) by 278 days.

(21) Appl. No.: 13/570,790

(22) Filed: Aug. 9, 2012

(65) Prior Publication Data

US 2012/0302416 A1 Nov. 29, 2012

Related U.S. Application Data

(62) Division of application No. 12/407,260, filed on Mar. 19, 2009, now Pat. No. 8,262,550.

(51) Int. Cl.
*A24F 13/06* (2006.01)
*A24F 7/04* (2006.01)
(Continued)

(52) U.S. Cl.
CPC ..... *A24D 3/025* (2013.01); *A24D 3/0216* (2013.01); *A24D 3/061* (2013.01)

(58) Field of Classification Search
CPC .... A24D 3/0287; A24D 3/0225; G06F 11/24; A24C 5/47; A24C 5/474
USPC ..... 493/4, 39, 42, 45–50; 131/202, 215.2; 221/277
See application file for complete search history.

(56) References Cited

U.S. PATENT DOCUMENTS 2,001,709 A * 5/1935 Davidson ..... 131/361
3,039,367 A * 6/1962 Stezler et al. ..... 493/47
(Continued)

FOREIGN PATENT DOCUMENTS

CN 88103246 12/1988
CN 1849209 10/2006
(Continued)

OTHER PUBLICATIONS

Borschke, A. J., "Review of Technologies Relating to Menthol Use in Cigarettes", *Rec. Adv. Tob. Sci.*, 1993, pp. 47-70, No. 19.
(Continued)

*Primary Examiner* — Stephen F Gerrity
*Assistant Examiner* — Eyamindae Jallow
(74) *Attorney, Agent, or Firm* — Womble Carlyle Sandridge & Rice, LLP

(57) ABSTRACT

An apparatus and associated method is provided for forming a rod for use in the manufacture of cigarette filter elements. A continuous supply of a filter material is formed into a continuous filter rod by a rod-forming unit. An object insertion unit is configured to insert a plurality of first objects and a plurality of second objects into the continuous filter rod. A rod-dividing unit is configured to subdivide the continuous filter rod, at predetermined intervals along the longitudinal axis thereof, into a plurality of filter rod portions such that each filter rod portion includes at least one first object and at least one second object disposed therein, with the first objects being different from the second objects.

12 Claims, 8 Drawing Sheets

(51) Int. Cl.
*A24D 3/02* (2006.01)
*A24D 3/06* (2006.01)

(56) References Cited

U.S. PATENT DOCUMENTS 3,052,163 A * 9/1962 Schubert ..... 493/39
3,052,164 A * 9/1962 Rowlands ..... 493/45
3,064,541 A * 11/1962 Mantchev ..... 493/45
3,199,418 A * 8/1965 Schubert ..... 493/41
3,267,820 A * 8/1966 Molins et al. ..... 493/45
3,288,147 A 11/1966 Molins et al.
3,297,038 A 1/1967 Homburger
3,308,600 A 3/1967 Erdmann et al.
3,308,832 A * 3/1967 Stelzer et al. ..... 131/94
3,312,151 A * 4/1967 Molins ..... 493/47
3,312,152 A * 4/1967 Williamson et al. ..... 493/47
3,339,557 A 9/1967 Karalus
3,339,558 A 9/1967 Waterbury
3,348,455 A * 10/1967 Williamson et al. ..... 493/47
3,366,121 A 1/1968 Carty
3,373,750 A * 3/1968 Beam ..... 131/339
3,390,039 A * 6/1968 Caughman et al. ..... 156/166
3,390,686 A 7/1968 Irby, Jr. et al.
3,420,242 A 1/1969 Boukair
3,424,172 A 1/1969 Neurath et al.
3,428,049 A 2/1969 Leake et al.
3,464,324 A * 9/1969 Pinkham ..... 493/47
3,464,421 A * 9/1969 Sherrill et al. ..... 131/61.1
3,508,558 A 4/1970 Seyburn
3,513,859 A 5/1970 Carty
3,547,009 A * 12/1970 Molins ..... 493/47
3,547,130 A 12/1970 Harlow et al.
3,550,508 A 12/1970 Wartman, Jr.
3,575,180 A 4/1971 Carty
3,596,665 A 8/1971 Lindgard
3,602,231 A 8/1971 Dock
3,610,112 A * 10/1971 Labbe et al. ..... 131/61.1
3,623,404 A * 11/1971 Jackson ..... 493/47
3,625,228 A 12/1971 Dock
3,635,226 A 1/1972 Horsewell et al.
3,638,661 A * 2/1972 Pinkham ..... 131/94
3,669,128 A 6/1972 Cohen
3,685,521 A 8/1972 Dock
3,797,644 A 3/1974 Shaw
3,915,176 A 10/1975 Heitmann et al.
3,916,914 A 11/1975 Brooks et al.
3,972,335 A 8/1976 Tiggelbeck et al.
3,991,773 A 11/1976 Walker
4,003,387 A 1/1977 Goldstein
4,046,153 A 9/1977 Kaye
4,059,043 A * 11/1977 Berger ..... 493/43
4,082,098 A 4/1978 Owens, Jr.
4,126,141 A 11/1978 Grossman
4,175,479 A * 11/1979 Roullier ..... 493/4
4,184,412 A 1/1980 Hall
4,280,187 A 7/1981 Reuland et al.
4,281,591 A * 8/1981 Boegli et al. ..... 493/45
4,281,670 A 8/1981 Heitmann et al.
4,281,671 A 8/1981 Bynre et al.
4,291,711 A * 9/1981 Berger ..... 131/336
4,291,713 A 9/1981 Frank
4,331,166 A * 5/1982 Hale ..... 131/331
4,411,640 A * 10/1983 Hall ..... 493/45
4,474,190 A 10/1984 Brand
4,476,807 A 10/1984 Pryor
4,549,875 A 10/1985 Pryor
4,574,816 A 3/1986 Rudszinat
4,677,995 A 7/1987 Kallianos et al.
4,729,391 A 3/1988 Woods et al.
4,736,754 A 4/1988 Heitmann et al.
4,781,203 A 11/1988 La Hue
4,807,809 A 2/1989 Pryor et al.
4,844,100 A 7/1989 Holznaget
4,848,375 A 7/1989 Patron et al.
4,850,301 A 7/1989 Greene, Jr. et al.
4,859,936 A 8/1989 Eccleston
4,862,905 A 9/1989 Greene, Jr. et al.
4,865,056 A 9/1989 Tamaoki et al.
4,878,506 A 11/1989 Pinck et al.
4,889,144 A 12/1989 Tateno et al.
4,925,602 A 5/1990 Hill et al.
4,941,486 A 7/1990 Dube et al.
5,012,823 A 5/1991 Keritsis et al.
5,012,829 A 5/1991 Thesing et al.
5,060,664 A 10/1991 Siems et al.
5,060,665 A 10/1991 Heitmann
5,156,169 A 10/1992 Holmes et al.
5,191,906 A 3/1993 Myracle, Jr.
5,220,930 A 6/1993 Gentry
5,225,277 A 7/1993 Takegawa et al.
5,271,419 A 12/1993 Arzonico et al.
5,331,981 A 7/1994 Tamaoki et al.
5,387,285 A 2/1995 Rivers
5,695,441 A * 12/1997 Irikura ..... 493/47
5,724,997 A 3/1998 Smith et al.
6,202,650 B1 * 3/2001 Kaneki et al. ..... 131/360
6,229,115 B1 5/2001 Voss et al.
6,360,751 B1 3/2002 Fagg et al.
6,584,979 B2 7/2003 Xue et al.
6,595,218 B1 * 7/2003 Koller et al. ..... 131/331
6,631,722 B2 10/2003 MacAdam et al.
6,647,870 B2 11/2003 Kohno
6,656,412 B2 * 12/2003 Ercelebi et al. ..... 264/518
6,701,934 B2 * 3/2004 Schlisio et al. ..... 131/94
6,723,033 B1 4/2004 Scott et al.
6,779,530 B2 8/2004 Kraker
6,848,449 B2 2/2005 Kitao et al.
6,904,917 B2 6/2005 Kitao et al.
7,032,445 B2 4/2006 Belcastro et al.
7,074,170 B2 7/2006 Lanier, Jr. et al.
7,079,912 B2 7/2006 Stack et al.
7,093,625 B2 8/2006 Smith et al.
7,115,085 B2 10/2006 Deal
7,210,486 B2 5/2007 Hartmann
7,234,471 B2 6/2007 Fitzgerald et al.
7,237,559 B2 7/2007 Ashcraft et al.
7,275,548 B2 10/2007 Hancock et al.
7,281,540 B2 10/2007 Barnes et al.
7,296,578 B2 11/2007 Read, Jr.
7,381,175 B2 6/2008 Dawson et al.
7,434,585 B2 10/2008 Holmes
7,479,098 B2 1/2009 Thomas et al.
7,578,298 B2 8/2009 Karles et al.
7,757,835 B2 7/2010 Garthaffner et al.
7,793,665 B2 * 9/2010 Dube et al. ..... 131/337
7,878,962 B2 * 2/2011 Karles et al. ..... 493/47
7,922,638 B2 * 4/2011 Draghetti et al. ..... 493/39
7,972,254 B2 7/2011 Stokes et al.
8,496,569 B2 * 7/2013 Balletti et al. ..... 493/39
2002/0119873 A1 * 8/2002 Heitmann ..... 493/39
2002/0166563 A1 11/2002 Jupe et al.
2003/0034085 A1 2/2003 Spiers et al.
2003/0136419 A1 7/2003 Muller
2004/0261807 A1 * 12/2004 Dube et al. ..... 131/337
2005/0066986 A1 3/2005 Nestor et al.
2005/0150507 A1 * 7/2005 Eusepi ..... A24D 3/0287 131/336
2006/0090769 A1 5/2006 Woodson et al.
2006/0096605 A1 5/2006 Karles et al.
2006/0112963 A1 6/2006 Scott et al.
2006/0112964 A1 6/2006 Jupe et al.
2006/0124143 A1 6/2006 Sherron et al.
2006/0130861 A1 6/2006 Luan et al.
2006/0135335 A1 6/2006 Dawson et al.
2006/0144412 A1 7/2006 Mishra et al.
2006/0174901 A1 8/2006 Karles et al.
2006/0196513 A1 9/2006 Atwell et al.
2006/0264130 A1 11/2006 Karles et al.
2006/0272655 A1 12/2006 Thomas et al.
2006/0272662 A1 12/2006 Jupe et al.
2006/0272663 A1 12/2006 Dube et al.
2006/0278543 A1 12/2006 Pham
2006/0278642 A1 12/2006 Pugne et al.
2006/0281614 A1 12/2006 Scott et al.

(56) References Cited

U.S. PATENT DOCUMENTS

| | | | | |
|---|---|---|---|---|
| 2006/0293157 | A1 | 12/2006 | Deal | |
| 2007/0000505 | A1 | 1/2007 | Zhuang et al. | |
| 2007/0012327 | A1 | 1/2007 | Karles et al. | |
| 2007/0023058 | A1 | 2/2007 | Howell et al. | |
| 2007/0023301 | A1 | 2/2007 | Pham | |
| 2007/0084476 | A1 | 4/2007 | Yang et al. | |
| 2007/0095357 | A1 | 5/2007 | Besso et al. | |
| 2007/0246055 | A1 | 10/2007 | Oglesby | |
| 2007/0284012 | A1 | 12/2007 | Smith et al. | |
| 2008/0017206 | A1 | 1/2008 | Becker et al. | |
| 2008/0029118 | A1 | 2/2008 | Nelson et al. | |
| 2008/0156336 | A1 | 7/2008 | Wyss-Peters et al. | |
| 2008/0163877 | A1 | 7/2008 | Zhuang et al. | |
| 2008/0230079 | A1 | 9/2008 | Besso et al. | |
| 2008/0286408 | A1 | 11/2008 | Karles et al. | |
| 2008/0302373 | A1 | 12/2008 | Stokes et al. | |
| 2009/0004337 | A1 | 1/2009 | Liu et al. | |
| 2009/0025736 | A1* | 1/2009 | Stewart et al. | 131/202 |
| 2009/0038628 | A1 | 2/2009 | Shen et al. | |
| 2009/0039102 | A1 | 2/2009 | Garthaffner et al. | |
| 2009/0145724 | A1 | 6/2009 | Garthaffner et al. | |
| 2009/0166376 | A1 | 7/2009 | Garthaffner et al. | |
| 2009/0277465 | A1 | 11/2009 | Karles et al. | |
| 2010/0184576 | A1 | 7/2010 | Prestia et al. | |
| 2013/0167851 | A1* | 7/2013 | Ademe et al. | 131/280 |
| 2013/0340777 | A1* | 12/2013 | Zhang et al. | 131/280 |

FOREIGN PATENT DOCUMENTS

| | | |
|---|---|---|
| EP | 0 295 518 | 12/1988 |
| JP | 59-38794 | 3/1984 |
| JP | 08-322538 | 12/1996 |
| JP | 2005-523680 | 8/2005 |
| WO | WO 00/51451 | 9/2000 |
| WO | WO 03/009711 | 2/2003 |
| WO | WO 03/016137 | 2/2003 |
| WO | WO 2006/000918 | 1/2006 |
| WO | WO 2006/136197 | 12/2006 |
| WO | WO 2006/136199 | 12/2006 |
| WO | WO 2007/010407 | 1/2007 |
| WO | WO 2007/060543 | 5/2007 |
| WO | WO 2008/081329 | 7/2008 |
| WO | WO 2008/084333 | 7/2008 |
| WO | WO 2008/146162 | 12/2008 |
| WO | WO 2008/146169 | 12/2008 |
| WO | WO 2008/154539 | 12/2008 |

OTHER PUBLICATIONS

Davis et al., *Tobacco Production, Chemistry and Technology*, 1999, pp. 440-460, Blackwell Science, Inc., Malden, MA.

Leffingwell et al., "Tobacco Flavoring for Smoking Products," *R.J. Reynolds Tobacco Company* (1972).

Office Action dispatched May 16, 2013 in corresponding Chinese Application No. 201080018140.1.

Office Action mailed Feb. 18, 2014 in corresponding Japanese Application No. 2012-500878.

* cited by examiner

METHOD OF FORMING A ROD FOR USE IN THE MANUFACTURE OF CIGARETTE FILTERS

CROSS-REFERENCE TO RELATED APPLICATIONS

This application is a divisional of U.S. patent application Ser. No. 12/407,260, filed Mar. 19, 2009, now U.S. Pat. No. 8,262,550 which is hereby incorporated herein in its entirety.

BACKGROUND OF THE INVENTION

1. Field of the Invention

Embodiments of the present invention relate to apparatuses and methods for manufacturing filter rods and smoking articles incorporating such filter rods, and, more particularly, to apparatuses and methods for inserting different objects into a filter element of a smoking article, such as a cigarette.

2. Description of Related Art

Popular smoking articles, such as cigarettes, have a substantially cylindrical rod shaped structure and include a charge, roll or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." A cigarette can incorporate a filter element having multiple segments, and one of those segments can comprise activated charcoal particles. Typically, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) (1999). A cigarette is employed by a smoker by lighting one end thereof and burning the tobacco rod. The smoker then receives mainstream smoke into his/her mouth by drawing on the opposite end (e.g., the filter end) of the cigarette.

The sensory attributes of cigarette smoke can be enhanced by applying additives to tobacco and/or by otherwise incorporating flavoring materials into various components of a cigarette. See, Leffingwell et al., *Tobacco Flavoring for Smoking Products*, R. J. Reynolds Tobacco Company (1972). For example, one type of tobacco flavoring additive is menthol. See, Borschke, *Rec. Adv. Tob. Sci.,* 19, p. 47-70, 1993. Various proposed methods for modifying the sensory attributes of cigarettes have involved suggestion that filter elements may be used as vehicles for adding flavor to the mainstream smoke of those cigarettes. US Pat. Appl. Pub. No. 2002/0166563 to Jupe et al. proposes the placement of adsorbent and flavor-releasing materials in a cigarette filter. U.S. Pat. No. 6,584,979 to Xue et al. proposes the placement of fibers containing small particle size adsorbents/absorbents in the filter. U.S. Pat. No. 4,941,486 to Dube et al. and U.S. Pat. No. 4,862,905 to Green, Jr. et al. propose the placement of a flavor-containing pellet in a cigarette filter. Other representative types of cigarette filters incorporating flavoring agents are set forth in U.S. Pat. No. 3,972,335 to Tiggelbeck et al.; U.S. Pat. No. 4,082,098 to Owens, Jr.; U.S. Pat. No. 4,281,671 to Byrne; U.S. Pat. No. 4,729,391 to Woods et al.; and U.S. Pat. No. 5,012,829 to Thesing et al.

Cigarettes having adjustable filter elements that allow smokers to select the level of flavor that is available for transfer into mainstream smoke have been proposed. See, for example, U.S. Pat. No. 4,677,995 to Kallianos et al. and U.S. Pat. No. 4,848,375 to Patron et al. Some proposed cigarettes may be manipulated, reportedly for the purpose of providing components of their filter elements with the propensity to modify the nature or character of mainstream smoke. See, for example, U.S. Pat. No. 3,297,038 to Homburger; U.S. Pat. No. 3,339,557 to Karalus; U.S. Pat. No. 3,420,242 to Boukar; U.S. Pat. No. 3,508,558 to Seyburn; U.S. Pat. No. 3,513,859 to Carty; U.S. Pat. No. 3,596,665 to Kindgard; U.S. Pat. No. 3,669,128 to Cohen; and U.S. Pat. No. 4,126,141 to Grossman.

Some proposed cigarettes have a hollow object positioned in their filter element, and the contents of that object is reportedly released into the filter element upon rupture of the object in the attempt to alter the nature or character of the mainstream smoke passing through the filter element. See, for example, U.S. Pat. No. 3,339,558 to Waterbury; U.S. Pat. No. 3,366,121 to Carty; U.S. Pat. No. 3,390,686 to Irby, Jr. et al.; U.S. Pat. No. 3,428,049 to Leake; U.S. Pat. No. 3,547,130 to Harlow et al; U.S. Pat. No. 3,575,1809 to Carty; U.S. Pat. No. 3,602,231 to Dock; U.S. Pat. No. 3,625,228 to Dock; U.S. Pat. No. 3,635,226 to Horsewell et al.; U.S. Pat. No. 3,685,521 to Dock; U.S. Pat. No. 3,916,914 to Brooks et al.; U.S. Pat. No. 3,991,773 to Walker; U.S. Pat. No. 4,889,144 to Tateno et al.; and U.S. Pat. No. 7,115,085 to Deal; US Pat. Application Pub. Nos. 2004/0261807 to Dube et al; 2007/0095357 to Besso et al.; 2007/0012327 to Karles et al.; 2006/0174901 to Karles et al.; 2006/0144412 to Mishra et al.; and 2006/0112964 to Jupe et al.; and PCT WO 03/009711 to Kim and WO 2007/060543 to Besso et al. Some proposed cigarettes may also have a capsule positioned in the filter element, and the contents of that capsule reportedly released into the filter element upon rupture of the capsule in order to deodorize the filter element after the cigarette is extinguished. See, for example, U.S. Pat. No. 6,631,722 to MacAdam et al.

Commercially marketed "Rivage" brand cigarettes have included a filter possessing a cylindrical plastic container containing water or a liquid flavor solution. Cigarettes representative of the "Rivage" brand cigarettes are described in U.S. Pat. No. 4,865,056 to Tamaoki et al. and U.S. Pat. No. 5,331,981 to Tamaoki et al., both of which are assigned to Japan Tobacco, Inc. The cylindrical casing within the filter reportedly may be deformed upon the application of external force, and a thin wall portion of the casing is consequently broken so as to permit release of the liquid within the casing into an adjacent portion of that filter.

A cigarette holder has been available under the brand name "Aquafilter." Cigarette holders representative of the "Aquafilter" brand product are described in U.S. Pat. No. 3,797,644 to Shaw; U.S. Pat. No. 4,003,387 to Goldstein; and U.S. Pat. No. 4,046,153 to Kaye; assigned to Aquafilter Corporation. Those patents propose a disposable cigarette holder into which the mouth end of a cigarette is inserted. Smoke from the cigarette that is drawn through the holder reportedly passes through filter material impregnated with water. A disposable filter adapted to be attachable to the mouth end of a cigarette has been proposed in U.S. Pat. No. 5,724,997 to Smith et al. A flavor-containing capsule contained within the disposable filter reportedly may be squeezed in order to release the flavor within the capsule.

Some smokers might desire a cigarette that is capable of providing, in some instances, selectively, a variety of different flavors, depending upon the smoker's immediate desire. The flavor of such a cigarette might be selected based on the smoker's desire for a particular flavor at that time, or a desire to change flavors during the smoking experience. For example, changing flavors during the smoking experience may enable a smoker to end the cigarette with a breath freshening flavor, such as menthol or spearmint. Accordingly, it would be desirable to provide a cigarette that is capable of providing distinctive and different pleasurable sensory experiences, for a smoker.

Some smokers might also desire a cigarette that is capable of releasing a deodorizing agent upon completion of a smoking experience. Such agents may be used to ensure that the remaining portion of a smoked cigarette yields a pleasant aroma after the smoker has finished smoking that cigarette. Accordingly, it may be desirable to provide a cigarette that is capable of releasing a deodorizing agent, as desired by the smoker.

Some smokers might desire a cigarette that is capable of moistening, cooling, or otherwise modifying the nature or character of the mainstream smoke generated by that cigarette. Because certain agents that can be used to interact with smoke are volatile and have the propensity to evaporate over time, the effects of those agents upon the behavior of those cigarettes may require introduction of those agents near commencement of the smoking experience. Accordingly, it may be desirable to provide a cigarette that is capable of moistening, smoothing or cooling the smoke delivered to a smoker, for that smoker.

It may also be desirable to provide a smoker with the ability to enhance a sensory aspect of his/her smoking experience, and/or the extent or magnitude of that sensory experience, such as can be accomplished by allowing the smoker to purposefully select a cigarette having certain characteristics or behaviors and, in some instances, by allowing the smoker to determine the magnitude or extent of such characteristics or behaviors that the cigarette exhibits and/or the source thereof. That is, it may be desirable to provide a cigarette possessing components that can be employed so as to allow the smoker to select a cigarette based on an indicated character or nature and, in some instances, allow the smoker to control, whether selectively or not, the nature or character of the mainstream smoke produced by that cigarette, and the source from which it is obtained. In particular, it may be desirable to provide a cigarette that is capable of enhancing the sensory attributes, and the extent or magnitude of such attributes, of the mainstream smoke (e.g., by flavoring that smoke). More particularly, it may be desirable to facilitate the manufacture of such cigarettes incorporating such flavor agents and sources, and the like, in a rapid, highly-automated fashion. It also may be desirable to provide an improved manner of incorporating discrete smoke-altering solid objects such as flavor pellets, flavor capsules, adsorbent/absorbent particles, and/or various combinations thereof, into cigarette filters, in a rapid, highly automated fashion.

In light of the above desirable attributes, it may also be desirable to provide a smoker with one or more visual cues of the sensory enhancements (i.e., characteristic, behavior, the magnitudes thereof and/or combinations thereof) present in a particular cigarette, so as to be, for example, informative to the smoker in selecting a cigarette, or instructive to the smoker as to accessing the available sensory enhancements.

BRIEF SUMMARY OF THE INVENTION

The present invention relates to an apparatus and process for providing filter rods for use in the manufacture of smoking articles, wherein each rod has one or more first objects (e.g., rupturable capsules, pellets) and one or more second objects (e.g., rupturable capsules, pellets) disposed along its length such that, when the rod is subdivided into rod portions, each rod portion includes at least one first object and at least one second object. In particular aspects, the first objects are different from the second objects. Embodiments of the apparatus incorporate equipment for supplying a continuous supply of filter material to form a continuous filter rod (e.g., a filter tow processing unit adapted to supply filter tow to a continuous rod forming unit). A representative apparatus may also at least partially incorporate, for example, a rotating wheel arrangement such as disclosed in U.S. Pat. No. 7,479,098 to Thomas et al. and U.S. Patent Application Publication No. US 2008/0302373 A1 to Stokes et al. (each incorporated herein by reference). In some aspects, the first and second objects are supplied in a particular order into the filter material forming the continuous filter rod. A representative apparatus also includes a first and second rotatable feeder device for respectively delivering first and second objects to a rotating wheel insertion arrangement for insertion of the first and second objects into the filter material forming the continuous filter rod.

As a result, the filter material is formed into a continuous filter rod having the first and second objects positioned within that rod and along the longitudinal axis thereof. The continuous filter rod then is subdivided at predetermined axial intervals so as to form a plurality of filter rods or filter rod portions, such that each filter rod portion defines a plurality of cigarette filter elements, each having at least one first object and at least one second object therein. Accordingly, embodiments of the present invention are particularly configured to provide the first and second objects and place the same within the filter material forming the continuous filter rod, with the first and second objects being appropriately proximal to each other such that a desired combination of at least one first object and at least one second object per filter rod portion may be obtained when the continuous filter rod is subdivided.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 10:
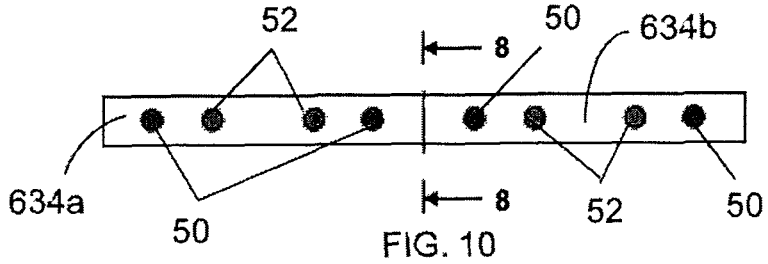
FIG. 10 is a cross-sectional view of a representative subdivided filter rod, including filter material and first and second objects positioned therein, according to one aspect of the present invention.
Figure 11:
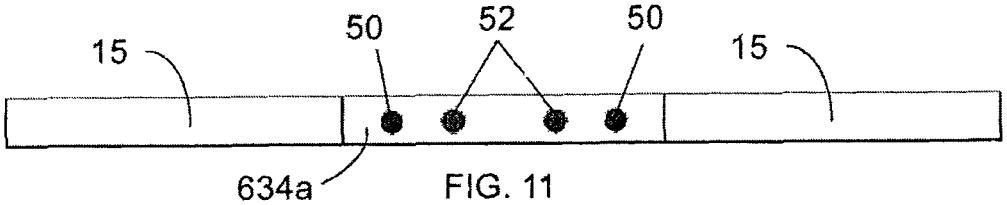
Figure 12:
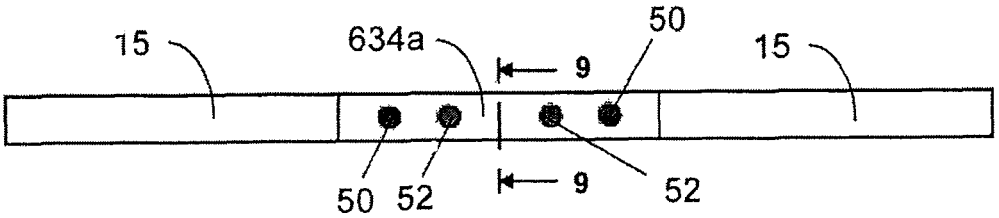
Figure 13:
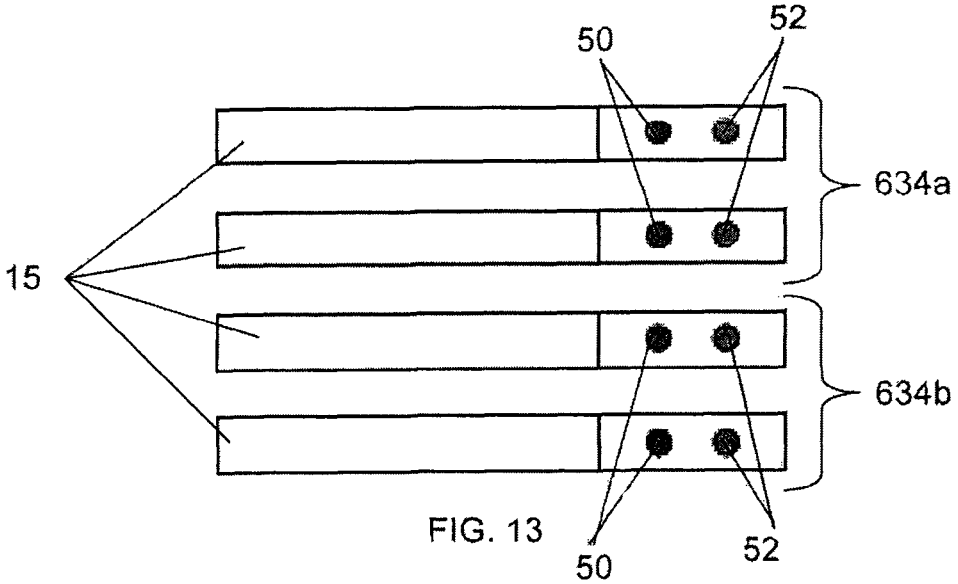

FIGS. 11 and 12 are cross-sectional views of the filter rod of FIG. 10 having tobacco rod portions coupled to opposing ends thereof, according to one aspect of the present invention; and FIG. 13 is a cross-sectional view of smoking articles formed from the filter rod of FIG. 10, with each smoking article formed therefrom having the first and second objects disposed in the filter element in the same orientation with respect to the tobacco rod portion, according to one aspect of the present invention.

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Cigarette rods are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. No. 4,781,203 to La Hue; U.S. Pat. No. 4,844,100 to Holznagel; U.S. Pat. No. 5,156,169 to Holmes et al.; U.S. Pat. No. 5,191,906 to Myracle, Jr. et al.; U.S. Pat. No. 6,647,870 to Blau et al.; U.S. Pat. No. 6,848,449 to Kitao et al.; U.S. Pat. No. 6,904,917 to Kitao et al.; U.S. Pat. No. 7,210,486 to Hartmann; U.S. Pat. No. 7,234,471 to Fitzgerald et al.; U.S. Pat. No. 7,275,548 to Hancock et al., and U.S. Pat. No. 7,281,540 to Barnes et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. No. 3,288,147 to Molins et al.; U.S. Pat. No. 3,915,176 to Heitmann et al; U.S. Pat. No. 4,291,713 to Frank; U.S. Pat. No. 4,574,816 to Rudszinat; U.S. Pat. No. 4,736,754 to Heitmann et al. U.S. Pat. No. 4,878,506 to Pinck et al.; U.S. Pat. No. 5,060,665 to Heitmann; U.S. Pat. No. 5,012,823 to Keritsis et al. and U.S. Pat. No. 6,360,751 to Fagg et al.; and U.S. Patent Application Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Filtered cigarettes incorporating filter elements provided from filter rods that are produced in accordance with the present invention can be manufactured using traditional types of cigarette making techniques. For example, so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. No. 3,308,600 to Erdmann et al.; U.S. Pat. No. 4,281,670 to Heitmann et al.; U.S. Pat. No. 4,280,187 to Reuland et al.; U.S. Pat. No. 6,229,115 to Vos et al.; U.S. Pat. No. 7,296,578 to Read, Jr.; and U.S. Pat. No. 7,434,585 to Holmes; each of which is incorporated herein by reference. The operation of those types of devices will be readily apparent to those skilled in the art of automated cigarette manufacture.

Cigarette filter rods that are produced in accordance with the present invention can be used to provide multi-segment filter rods. Such multi-segment filter rods can be employed for the production of filtered cigarettes possessing multi-segment filter elements. An example of a two-segment filter element is a filter element possessing a first cylindrical segment incorporating activated charcoal particles (e.g., a "dalmation" type of filter segment) at one end, and a second cylindrical segment that is produced from a filter rod produced in accordance with embodiments of the present invention. The production of multi-segment filter rods can be carried out using the types of rod-forming units that have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany.

Various types of cigarette components, including tobacco types, tobacco blends, top dressing and casing materials, blend packing densities; types of paper wrapping materials for tobacco rods, types of tipping materials, and levels of air dilution, can be employed. See, for example, the various representative types of cigarette components, as well as the various cigarette designs, formats, configurations and characteristics, which are set forth in U.S. Pat. No. 5,220,930 to Gentry, U.S. Pat. No. 6,779,530 to Kraker, and U.S. Pat. No. 7,237,559 to Ashcraft et al.; and U.S. Patent Application Publication Nos. 2005/0066986 to Nestor et al., 2006/0272655 to Thomas et al., and 2007/0246055 to Oglesby; each of which is incorporated herein by reference.

Filter rods can be manufactured pursuant to embodiments of the present invention using a rod-making apparatus, and an exemplary rod-making apparatus includes a rod-forming unit. Representative rod-forming units are available as KDF-2 and KDF-3E from Hauni-Werke Korber & Co. KG; and as Polaris—ITM Filter Maker from International Tobacco Machinery. Filter material, such as cellulose acetate filamentary tow, typically is processed using a conventional filter tow processing unit. For example, filter tow can be bloomed using bussel jet methodologies or threaded roll methodologies. An exemplary tow processing unit has been commercially available as E-60 supplied by Arjay Equipment Corp., Winston-Salem, N.C. Other exemplary tow processing units have been commercially available as AF-2, AF-3 and AF-4 from Hauni-Werke Korber & Co. KG. and as CandorITM Tow Processor from International Tobacco Machinery. Other types of commercially available tow processing equipment, as are known to those of ordinary skill in the art, can be employed. Other types of filter materials, such as gathered paper, nonwoven polypropylene web or gathered strands of shredded web, can be provided using the types of materials, equipment and techniques set forth in U.S. Pat. No. 4,807,809 to Pryor et al. and U.S. Pat. No. 5,025,814 to Raker. In addition, representative manners and methods for operating a filter material supply units and filter-making units are set forth in U.S. Pat. No. 4,281,671 to Bynre; U.S. Pat. No. 4,850,301 to Green, Jr. et al.; U.S. Pat. No. 4,862,905 to Green, Jr. et al.; U.S. Pat. No. 5,060,664 to Siems et al.; U.S. Pat. No. 5,387,285 to Rivers and U.S. Pat. No. 7,074,170 to Lanier, Jr. et al.

Representative types of filter rods incorporating objects, and representative types of cigarettes possessing filter elements incorporating objects, such as flavor-containing capsules or pellets, can possess the types of components, format and configuration, and can be manufactured using the types of techniques and equipment set forth in U.S. Patent Application Publication No. 2008/0029118 A1 to Nelson et al.; and U.S. Pat. No. 7,115,085 to Deal, U.S. Pat. No. 4,862,905 to Green, Jr. et al., and U.S. Pat. No. 7,479,098 to Thomas et al.; which are incorporated herein by reference in their entireties.

Figure 1:
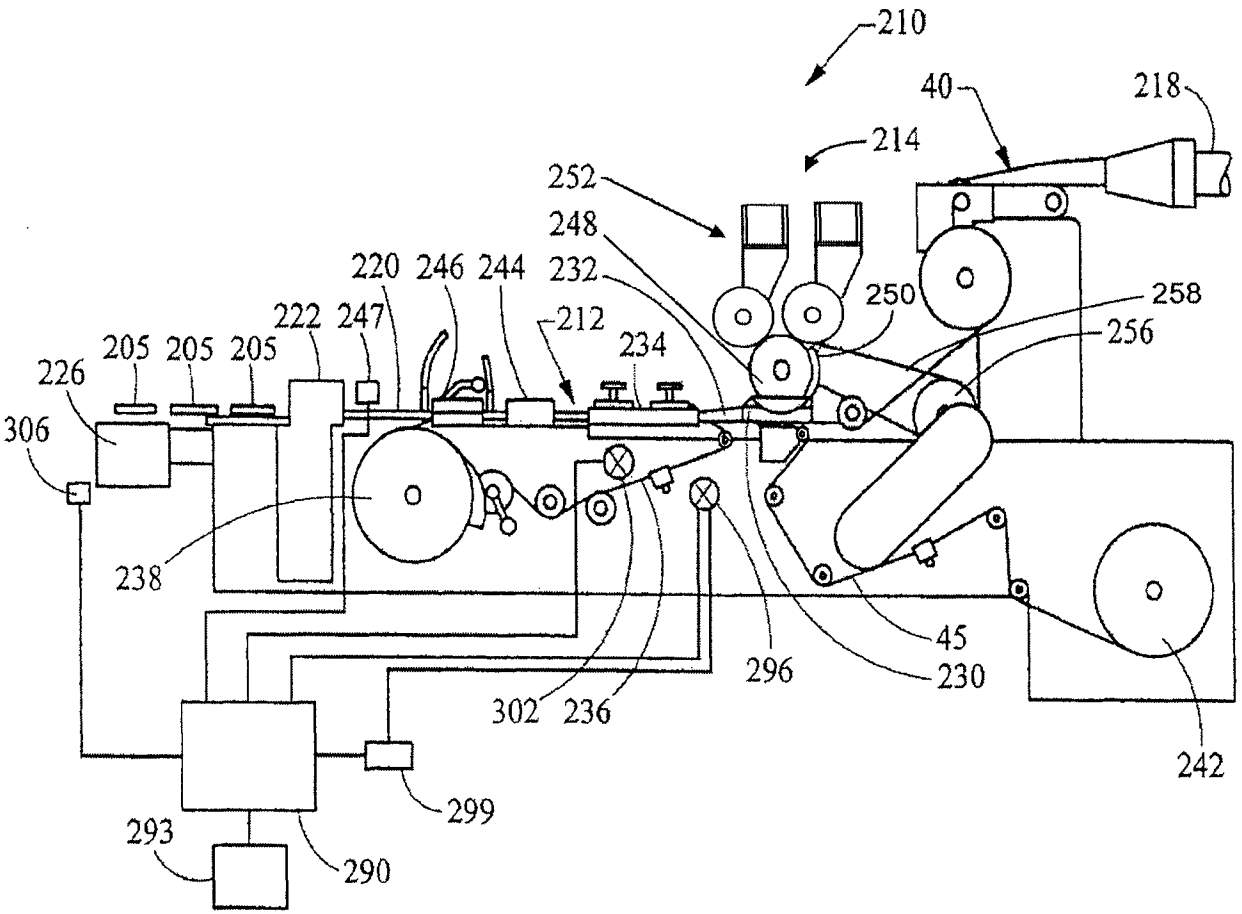
FIG. 1 is a schematic of a representative rod-making apparatus including a portion of the filter tow processing unit, a source of first objects, a source of second objects, an object insertion unit, and a filter rod-forming unit.

FIG. 1 illustrates that filter rods or filter rod portions 205, each incorporating at least one of each of a first and second object, such as spherical, capsular, cylindrical (i.e., pellets), or other suitably shaped objects, can be manufactured using a rod-making apparatus 210. An exemplary rod-making apparatus 210 includes a rod-forming unit 212 (e.g., a KDF-2 unit available from Hauni-Werke Korber & Co. KG) suitably adapted to process a continuous length of filter material 40 into a continuous filter rod 220. The continuous length or web of filter material is supplied from a source (not shown) such as a storage bale, bobbin, spool or the like. Generally, the filter material 40 is processed using a filter material processing unit 218 and passed through the rod-forming unit 212 to form the continuous rod 220. An object insertion unit 214 may be associated with the filter material processing unit 218 and/or the rod-forming unit 214 to place/insert the first and second objects (not shown) within the continuous length of filter material or the continuous filter rod 220, respectively. The continuous filter rod 220 can then be subdivided using a rod cutting assembly 222 into the plurality of rod portions 205 each having at least one of the first objects and at least one of the second objects disposed therein. The succession or plurality of rod portions 205 are collected for further processing in a collection device 226 which may be a tray, a rotary collection drum, conveying system, or the like. If desired, the rod portions can be transported directly to a cigarette making machine. In such a manner, in excess of 500 rod portions, each of about 100 mm in length, can be manufactured per minute.

The filter material 40 can vary, and can be any material of the type that can be employed for providing a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary tow such as cellulose acetate, polyolefins such as polypropylene, or the like. One preferred filter material that can provide a suitable filter rod is cellulose acetate tow having 3 denier per filament and 40,000 total denier. As another example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.

Filamentary tow, such as cellulose acetate, is processed using a conventional filter tow processing unit 218 such as a commercially available E-60 supplied by Arjay Equipment Corp., Winston-Salem, N.C. Other types of commercially available tow processing equipment, as are known to those of ordinary skill in the art, may similarly be used. Normally a plasticizer such as triacetin is applied to the filamentary tow in traditional amounts using known techniques. Other suitable materials for construction of the filter element will be readily apparent to those skilled in the art of cigarette filter design and manufacture.

The continuous length of filter material 40 is pulled through a block 230 by the action of the rod-forming unit 212, and directed into a gathering region thereof, to form a cylindrical composite. The gathering region can have a tongue and horn configuration, a gathering funnel configuration, stuffer or transport jet configuration, or other suitable type of gathering mechanism. The tongue 232 provides for further gathering, compaction, conversion or formation of the cylindrical composite from block 230 into an essentially cylindrical (i.e., rod-like) shape whereby the continuously extending strands or filaments of the filter material extend essentially along the longitudinal axis of the cylinder so formed. The filter material 40, which has been compressed into the cylindrical composite, is continuously received into the rod-forming unit 212 to form the continuous filter rod 220. In conjunction with the formation of the continuous filter rod 220, the first and second objects may be inserted along the length of and within the web of filter material as that filter material is being formed into the continuous filter rod 220 and/or after the filter material is formed into the continuous filter rod 220 (i.e., at any point along the rod-forming unit 212 (or upstream or downstream thereof). However, the first and second objects may also be introduced into the filter material at other points in the process and this exemplary embodiment is not intended to be limiting in that regard. In order to insert the first and second objects into the continuous filter rod, the rod-forming unit 212 may include an element-dividing mechanism (not shown) disposed upstream of the object insertion unit 214. In some instances, the element-dividing mechanism may be the object insertion unit 214 (or portion thereof) itself.

The cylindrical composite is fed into wrapping mechanism 234, which includes endless garniture conveyor belt 236 or other garniture mechanism. The garniture conveyor belt 236 is continuously and longitudinally advanced using an advancing mechanism 238, such as a ribbon wheel or cooperating drum, so as to transport the cylindrical composite through wrapping mechanism 234. The wrapping mechanism provides a strip of wrapping material 45 (e.g., non-porous paper plug wrap) to the outer surface of the cylindrical composite in order to produce a continuous wrapped filter rod 220.

Generally, the strip or web of wrapping material 45 is provided from rotatable bobbin 242. The wrapping material is drawn from the bobbin, is trained over a series of guide rollers, passes under block 230, and enters the wrapping mechanism 234 of the rod-forming unit. The endless garniture conveyor belt 236 transports both the strip of wrapping material and the cylindrical composite in a longitudinally extending manner through the wrapping mechanism 234 while draping or enveloping the wrapping material about the cylindrical composite.

The seam formed by an overlapping marginal portion of wrapping material has adhesive (e.g., hot melt adhesive) applied thereto at applicator region 244 in order that the wrapping material can form a tubular container for the filter material. Alternatively, the hot melt adhesive may be applied directly upstream of the wrapping material's entry into the garniture of the wrapping mechanism 234 or block 230, as the case may be. The adhesive can be cooled using chill bar 246 in order to cause rapid setting of the adhesive. It is understood that various other sealing mechanisms and other types of adhesives can be employed in providing the continuous wrapped rod.

The continuous wrapped rod 220 passes from the sealing mechanism and is subdivided (e.g., severed) at regular intervals at the desired, predetermined length using cutting assembly 222, which may include as a rotary cutter, a highly sharpened knife, or other suitable rod cutting or subdividing mechanism. It is particularly desirable that the cutting assembly does not flatten or otherwise adversely affect the cross-sectional shape of the rod. The rate at which the cutting assembly severs the continuous rod at the desired points is controlled via an adjustable mechanical gear train (not shown), or other suitable mechanism. The rate at which the first and second objects are inserted into the continuous web of filter material/continuous filter rod is in a direct relationship to the speed of operation of the rod-making machine. The object insertion unit 214 can be geared in a direct drive relationship to the drive assembly of the rod-making apparatus. Alternatively, the object insertion unit 214 can have a direct drive motor synchronized with the drive assembly of the rod-forming unit and feedback controlled by coupling with the object inspection mechanism 247 to adjust the insertion unit drive assembly should the object insertion location shift out of position. In light of the relationship of the rate of object insertion and the rod-making machine, embodiments of the present invention are also directed to increasing the production rate of the rod-making machine without adversely affecting the object placement within the filter material.

Figure 2:
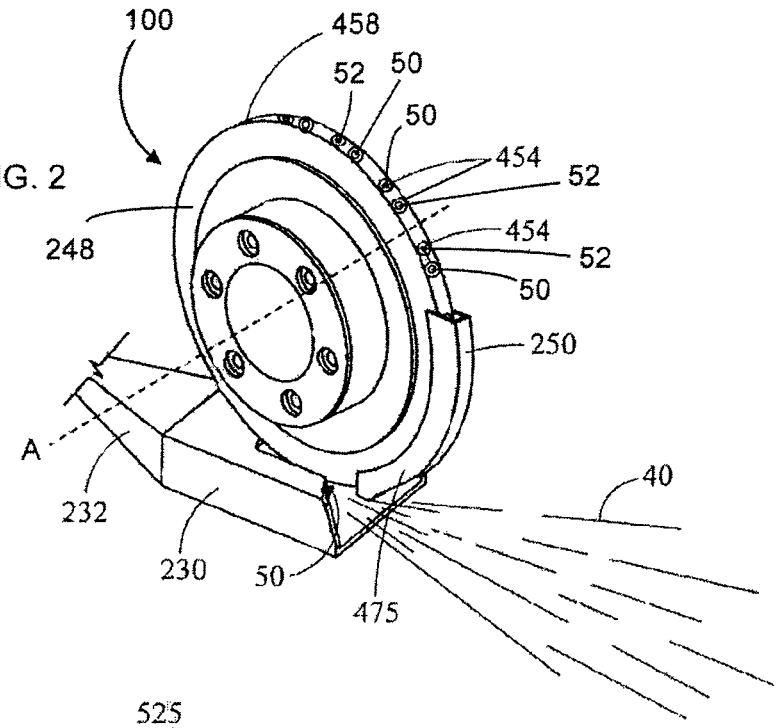
FIG. 2 is a perspective view of a portion of an object insertion unit illustrating a rotatable insertion device, according to one embodiment of the present invention.

Referring to FIG. 2, in one example, the object insertion unit 214 may include an insertion device 100 having a rotatable insertion member 248 shape, for example, as a wheel, which may be positioned so as to rotate about a first axis A in a vertical plane. The rotatable insertion member 248 may have a peripheral face 458 extending parallel to the first axis A and defining a plurality of spaced-apart pockets 454, each pocket 454 being of sufficient shape and size to accommodate one of the first and second objects. Individual first and second objects 50, 52 are placed into corresponding individual pockets 454 located at predetermined intervals along the peripheral face 458 of the rotatable insertion member 248. A vacuum or negative pressure assembly may be in fluid communication with the rotatable insertion member 248 such that a vacuum or suction may be applied to each pocket 454, in a radially-inward direction with respect to the first axis A. The vacuum/suction acts to assist in ensuring that each pocket 454 accepts the corresponding one of the first and second objects, and that each object within a pocket 454 is maintained in that pocket 454 during transport to the filter material 40. Each object may then be positioned at predetermined intervals within the filter material 40/continuous filter rod 220. In some instances, an ejection mechanism (i.e., a pressurized air emission device) may be in communication with the rotatable insertion member 248 and/or the pockets 454 defined thereby to eject the objects from the pockets. For example, pressurized air may be applied to each pocket 454, as appropriate, wherein the pressurized air acts to eject that object out of the pocket 454 at the desired time (e.g., when the object carried by the rotatable insertion member 248 is located at the desired location within respect to the filter material 40/continuous filter rod 220.

As the rotatable insertion member 248 rotates in a clockwise fashion, individual first and second objects (not shown) held within the pockets (not shown) on the peripheral face of the wheel are brought into contact with the filter material 40 within the block 230, where the first and second objects are ejected from the pockets into the gathered filter material 40/filter rod 220 As such, the first and second objects 50, 52 may be discretely or otherwise separately positioned within the filter material 40/filter rod 220 by a single insertion device 100. Details of an exemplary rotatable insertion arrangement are further detailed, for example, in U.S. Pat. No. 7,479,098 to Thomas et al., which is incorporated herein by reference in its entirety.

Figure 6:
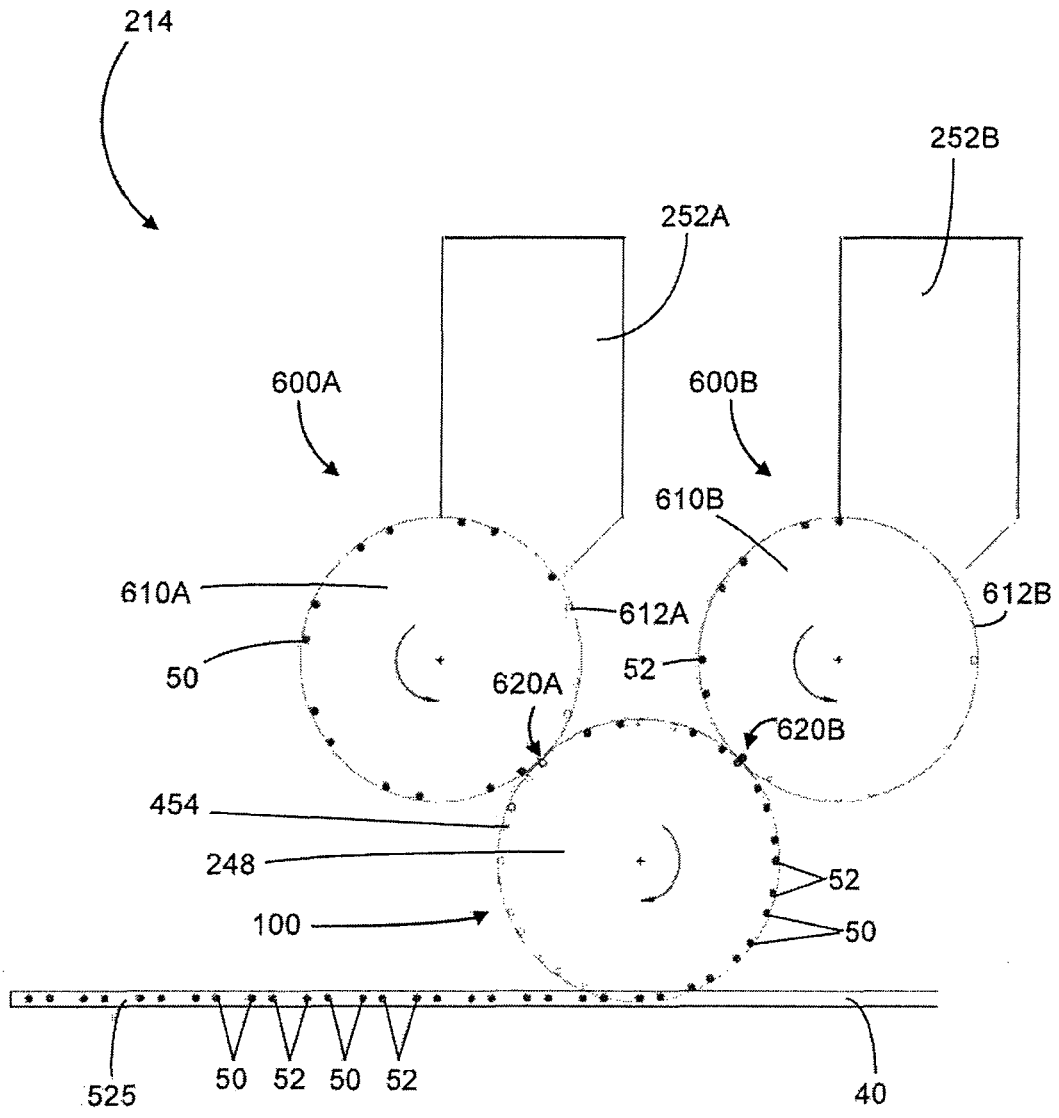
FIG. 6 is a schematic view of an object insertion unit illustrating placement of first and second objects within a continuous web of filter tow forming a continuous filter rod, according to one embodiment of the present invention.

Embodiments of the present invention may implement spacing patterns associated with the rotatable insertion member 248, for particularly distributing discrete first and second objects along the length of the continuous filter rod 220. That is, in one instance, the rotatable insertion member 248 may be configured so as to place particular pairs or other numbers of first and second objects in closer proximity to each other or immediately adjacent to each other to define a particular group of objects. For example, the pockets for those objects may be more closely spaced or the rotatable insertion member 248 may be configured in a different manner so as to, for instance, receive and deliver the groups of first and second objects in a substantially consistent and continuous feed according to the desired pattern. In some instances, the first and second objects may be inserted into the continuous filter rod 220 and along the axis thereof by the insertion device 100 in serially-disposed groups, wherein each successive group may have the first and second objects 50, 52 alternatingly disposed along the longitudinal axis with respect to the previous group. For example, as shown in FIGS. 6 and 10, the first objects 50 and the second objects 52 are illustrated as being disposed along the longitudinal axis of the continuous rod in seriatim groups of two, wherein the successive groups alternate between of the relative order of the first object 50 with respect to the second object 52 along the axis. To that end, the first and second objects 50, 52 may be correspondingly disposed in similar groups in the pockets 454 of the insertion device 100 such that the first and second objects 50, 52 may be inserted into the continuous rod in such groupings. For example, as illustrated in FIG. 6, one pocket 454 may have a first object 50 therein while a successive pocket 454 also contains a first object 50, which may then be followed by two successive pockets 454 having second objects 52. However, the first and second objects 50, 52 may be spaced apart such that successive first and second objects 50, 52 are closer spaced than successive first objects 50 or successive second objects 52. In such instances, the groups of objects are represented by one first object 50 paired with one second object 52, though the relative order of the first and second objects 50, 52 in successive groups is alternatingly reversed. In this manner, the insertion device 100 may serially insert alternating groups of first and second objects 50, 52 into the continuous rod of filter material though, as shown, in some instances, the spacing between inserted first objects 50 or inserted second objects 52 may be greater than that of the spacing between adjacent first and second objects 50, 52. That is, dissimilar objects may be spaced closer along the longitudinal axis of the continuous rod than similar objects.

Referring to FIGS. 4A-4D and 5A-5E, the rotatable insertion member 248 may, in some instances, further include a retaining member 470 incorporated, engaged with, or otherwise received in each pocket 454 so as to be associated therewith. The retaining member 470 may be configured as a screen, a perforated member, a sieve or sieve-like member, or any other retaining structure that permits air to flow therethrough. As such, each pocket 454 may be capable of receiving and maintaining a plurality of objects therein, wherein each object may be relatively small as compared to the dimensions of the pocket 454 itself. In addition, the pocket 454 may be in communication with a channel 474 fluidly connected to the vacuum/negative pressure assembly, wherein the negative pressure applied to the pocket 454 via the channel inlet 472 may facilitate the maintenance of the objects within the pocket 454 during rotation of the insertion member 248. The retaining member 470 thus permits the vacuum/negative pressure assembly to draw air radially inwardly through the pocket 454 with respect to the peripheral face 458 such that the relatively small object(s) may be maintained in the respective pocket 454 rather than being drawn into a channel 474 or blocking the channel inlet 472. Accordingly, objects smaller than the pocket 454 may be received and carried by the rotatable insertion member 248 for insertion within the filter material 40/filter rod 220.

In some instances, the retaining member 470 may be inserted (FIGS. 5A-5E) within the pocket 454, the channel inlet 472, and/or the channel 474 to prevent the relatively small objects (i.e., minicapsules, microcapsules, or other miniature objects) from being drawn into the channel 474. That is, the pocket 454, the channel inlet 472, and/or the channel 474 may be configured to receive the retaining member 470 such that the retaining member 470 is maintained therein by an interference fit or other suitable mechanism, either temporarily or permanently. In one embodiment, the retaining member 470 may have a frustoconical portion 476 extending into the channel 474 and a lip portion 478 integral therewith to prevent the retaining member 470 from being drawn into the channel 474. In other instances, the retaining member 470 may be incorporated into or otherwise defined by the pocket 454, the channel inlet 472, and/or the channel 474. In this regard, the retaining member 470 may be integral (FIGS. 4A-4E) with the rotatable insertion member 248 in a permanent manner. In such instances, the channel inlets 472 and/or channels 474 may be appropriately connected to the pocket 454 or otherwise material removed from the pocket 454 to fluidly connect the pocket 454 with the vacuum/negative pressure assembly.

In some instances, the retaining member 470 may also facilitate stacking of the objects (or otherwise the insertion of a plurality of such objects) within the pocket 454. In this regard, the air drawn through the retaining member 470 is of substantial force to maintain multiple objects within the pocket 454, wherein some of such objects may not necessarily be directly adjacent the retaining member 470. The insertable or integral retaining member 470 may be of any suitable shape, size, or configuration which substantially prevents the relatively small objects from entering the channel 474 or blocking the channel inlet 472, while allowing air to be drawn into the channel 474 to maintain the objects within the pocket 454 during rotation of the insertion member 248. For example, the axial cross-section of the pocket 454, and thus the retaining member 470, may be substantially circular (FIG. 4D) or elliptical (FIG. 5E) in shape. Further, the channel inlets 472 may be configured in any suitable shape and size for effectuating an appropriate suction for maintaining the objects within the pocket 454.

Referring to FIG. 6, the object insertion unit 214 may further include first and second delivery systems for delivering or otherwise feeding the respective first and second objects to the insertion device 100. That is, the first and second objects 50, 52 may be separately and discretely delivered to the insertion device 100 (e.g., rotatable insertion member 248) by respective first and second delivery systems 600A, 600B such that the objects are transferred therebetween. The first and second delivery systems 600A, 600B may be similarly configured, with each including a rotatable feeder device 610A, 610B for delivering or otherwise providing the respective first and second objects 50, 52 to the insertion device 100 for insertion into the filter material 40/filter rod 220. As each rotatable feeder device 610A, 610B rotates in a counter clock-wise fashion (as shown in FIG. 6), respective individual first and second objects (or pluralities of first and second objects when using "miniature" objects and the retaining member 470) held within feeder pockets 612A, 612B on a peripheral face of the respective rotatable feeder device 610A, 610B may be brought into a transfer position, generally designated as 620A, 620B, respectively, with the rotatable insertion member 248. At the transfer position, certain feeder pockets 612A, 612B are positioned in registration with corresponding pockets 454 of the rotatable insertion member 248. As such, in the transfer position, the respective first and second objects may be ejected or otherwise transferred from the feeder pockets 612A, 612B into the pockets 454 of the rotatable insertion device 248. In this manner, the rotatable feeder devices 610A, 610B cooperate with the insertion device 100 to transfer, exchange, or otherwise deliver the respective first and second objects thereto in the order previously noted herein. In some instances, the rotatable feeder devices 610A, 610B may each employ a vacuum/negative pressure assembly (similar to that of the insertion device 248) to maintain the objects within the feeder pockets 612A, 612B during rotation of the rotatable feeder devices 610A, 610B. Further, the rotatable feeder devices 610A, 610B may each be configured to eject the objects from the feeder pockets 612A, 612B at the transfer positions 620A, 620B via positive air pressure or otherwise by interrupting the suction/negative pressure applied to the feeder pockets 612A, 612B at the transfer position.

Figure 9:
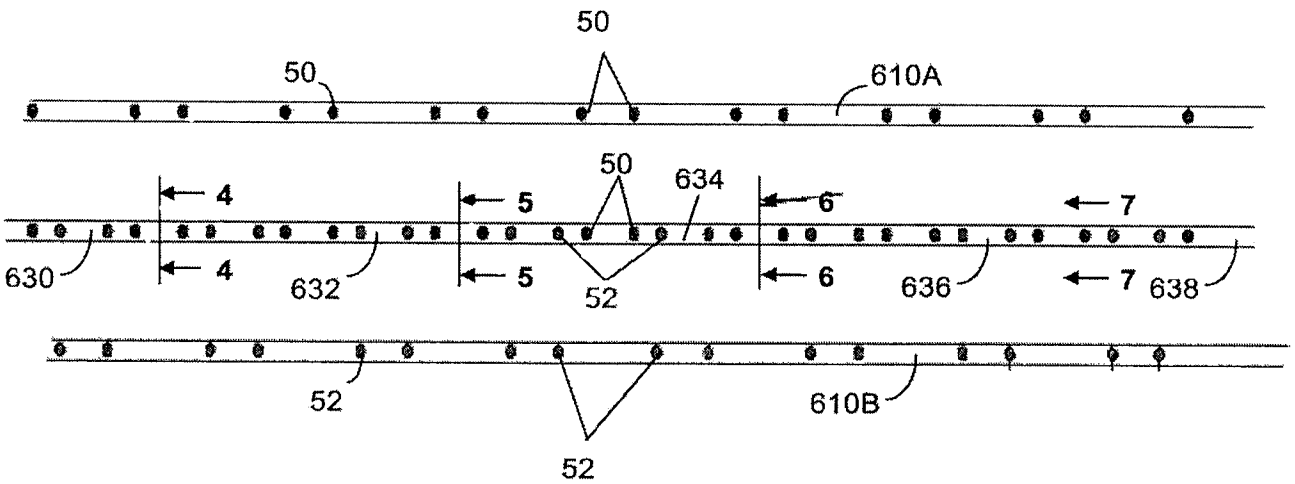
FIG. 9 is a schematic diagram illustrating a relationship between an insertion device and first and second feeder devices configured to respectively deliver first and second objects to the insertion device, according to one embodiment of the present invention.

With continuing reference to FIG. 6, the spacing of the feeder pockets 612A, 612B may be greater than that of the pockets 454 of the insertion member 248, due to the presence of two delivery sources for supplying the first and second objects 50, 52 to the insertion member 248. Further, the rotatable feeder devices may supply first and second objects 50, 52 such that a pair of the same objects is adjacently-disposed to each other and with respect to the insertion member 248, with the pairs of objects alternating about the insertion member 248, rather than alternating on a single object basis. In this regard, the first and second objects 50, 52 may be positioned within the filter material 40/filter rod 220 in, for example, pairs or groupings of first and second objects such that the continuous filter rod 220 can be subdivided into a plurality of rod portions, wherein each rod portion contains at least one first object 50 and at least one second object 52. FIG. 9 illustrates one exemplary embodiment of the relationship between the first and second rotatable feeder devices 610A, 610B with respect to the insertion device 100. In such an example, the respective first and second objects 50, 52 are each spaced-apart (i.e., each pair of objects is spaced apart) and delivered to the insertion device 100 in alternating groupings (i.e., a pair of first objects followed by a pair of second objects). Accordingly, once inserted into the filter material 40/filter rod 220, the groupings are serially-disposed along the longitudinal axis in a correspondingly alternating manner.

The first and second delivery systems 600A, 600B may each further include a respective hopper assembly 252A, 252B and/or other transfer mechanism for feeding or otherwise delivering the first and second objects 50, 52 (such as, for example, capsules and/or pellets, mini-capsules and/or mini-pellets, or combinations thereof) to the rotatable feeder devices 610A, 610B. In some instances, the insertion unit 214 may include a hopper assembly such as that further detailed, for example, in U.S. Pat. No. 7,479,098 to Thomas et al. (previously incorporated herein by reference). That is, each hopper assembly 252 may include an upper hopper that acts as a reservoir for a plurality of first or second objects, and provides for supply of same objects to a lower hopper. Passage of objects from the upper hopper to the lower hopper is promoted by vibrating the objects contained in the upper hopper, as well as (optionally) by employing a movable screening mechanism (e.g., a reciprocating bar possessing vertically extending passageways for object transport). The lower hopper is shaped so that the objects are stacked therein. The objects in the lower hopper are stacked on top of one another, but at a depth (when viewed looking toward the hopper) of a single object. The bottom of the lower hopper is shaped so as to cooperate with a portion of upper region of the respective rotatable feeder device 610A, 610B that is positioned so as to rotate in a vertical plane, and the objects are fed from the lower hopper into pockets or receptacles defined by the peripheral face of that rotatable feeder device. That is, objects within the lower hopper are delivered in single file to the pockets/receptacles defined along a portion of the peripheral face of the upper region of the rotatable feeder device. Having incorporated U.S. Pat. No. 7,479,098 to Thomas et al. by reference, the details and operation of the multi-portion hopper assembly 252A, 252B/feeder device 610A, 610B are not otherwise described in detail herein, but instead are referenced to that publication. The types of equipment, dimensions, operational parameters, and materials of construction hopper assembly/feeder device also find reference in U.S. Pat. No. 7,479,098 to Thomas et al. (previously incorporated herein by reference).

The feeder devices 610A, 610B and/or the insertion member 248 may be driven by respective pulley and belt assemblies coupled with the main drive assembly of the rod-making apparatus 210. Alternatively, the feeder devices 610A, 610B and/or the insertion member 248 may have independent drive motors synchronized with, or controlled by, the main drive assembly (not shown) of the rod-forming unit 212. Alternatively, feeder devices 610A, 610B and/or the insertion member 248 may be driven using independent drives that are servo-controlled for synchronization. For example, a servo system or drive system may be provided for controlling, aligning, or otherwise enabling operation of the configurations described herein. Such control systems, servo systems, or other drive system may be adapted from the control systems disclosed in U.S. Pat. No. 7,479,098 to Thomas et al. (previously incorporated herein by reference) for driving/operating a single wheel assembly.

Referring to FIG. 1, in controlling this process, a typical control system may include control hardware and software. An exemplary control system 290 can incorporate a Siemens 315-2DP Processor, a Siemens FM352-5 (Boolean processor) and a 16 input bit/16 output bit module. Such a system can utilize a system display 293, such as a Siemens MP370. A typical rod-making unit possesses internal controls whereby, for a rod of desired length, the speed of the knife of the severing unit is timed relative to the speed of continuous rod formation. A first encoder 296, by way of connection with the drive belt of the rod-making unit, and with the control unit 299 of the insertion unit 214, provides reference of the knife position of the cutting assembly relative to the wheel position of the insertion unit 214. Thus, the first encoder 296 provides a mechanism for allowing control of the speed of rotation of the wheel of the insertion unit 214 relative to the speed at which continuous web of filter tow passes through the rod-making unit. An exemplary first encoder is available as Heidenhain Absolute 2048.

An inspection/detection system 247 may be located near the cutting assembly. The detection system, such as an infrared detection system, relays information regarding the detection of a first and second object within the filter rod to the control system 290. Typically, the first and second objects within the filter rod are of a contrasting shade or color to be detected by visual detection sensors in the detection system 247. In other instances, the inspection/detection system 247 may be appropriately modified so as to be capable of detecting/inspecting various first and second objects. For example, the inspection/detection system 247 may be configured to detect/inspect a capsule, a pellet, or any multiples or combinations thereof. Such an inspection/detection system 247 is disclosed, for example, in U.S. Pat. No. 7,479,098 to Thomas et al. previously incorporated by reference.

The rod-making apparatus optionally can be equipped with a system adapted to provide information associated with rod production and operation event analysis. For example, a rod-making apparatus, such as a commercially available KDF-2 type of unit, can be adapted so as to be equipped with a central processing unit. A representative central processing unit is available as a Siemens 314-C processor. The central processing unit is equipped with input and output modules. As such, the operation of the rod-making unit can be monitored, and data so generated can be transferred to the central processing unit. In addition, data received by the central processing unit can be presented on a video touch screen or retrieved by a high level operating system (e.g., via an Ethernet). A remote unit such as Siemens IM-153 equipped with inputs, outputs and a counter module available as Siemens FM350-2 installed in sending unit collects data provided to the central processing unit using a bus system (e.g., Profibus). Depending upon information gathered, data that can be generated may relate to number of rods manufactured during a particular time frame, machine operating speed, manufacturing efficiency, number of stops, filters sent to a making machine and stoppage reasons.

Referring to FIG. 2, the continuous web of filter material 40 is fed into guide or block 230 (shown as partially cut away). The block 230 receives the wide band of filter material 40, and gradually forms the web into a composite, which generally resembles a cylindrical composite (continuous filter rod 220). In some instance, a plow region 475 of the ledger housing 250 separates or spreads the filter material 40/filter rod 220 such that the first and second objects 50, 52 may be ejected from the peripheral face 458 of the insertion member 248 and positioned or placed into the desired locations within the web of filter material 40/filter rod 220 and along the longitudinal axis thereof. When the tow reaches the endmost portion of the plow, the motion of the tow as it is drawn through the process, causes the tow to close itself back into the cylindrical composite, which thereby encloses, surrounds or contains the first and second objects 50, 52 deposited therein along the length of and within the continuous filter rod 220. A suitable plow preferably extends to a maximum depth of about 6 mm to about 6.5 mm into the web of filter material 40/filter rod 220. The insertion unit 214 can be raised or lowered (i.e., moved toward or away from the filter material 40/filter rod 220) in order that the first and second objects can be inserted at the desired depth within the filter material 40/filter rod 220. In such a manner, a series of first and second objects 50, 52 may be positioned, as desired, in the web of filter material along the length of and within the cylindrical composite that exits the block 230 and enters the tongue 232 or other suitable gathering mechanism.

Figure 3:
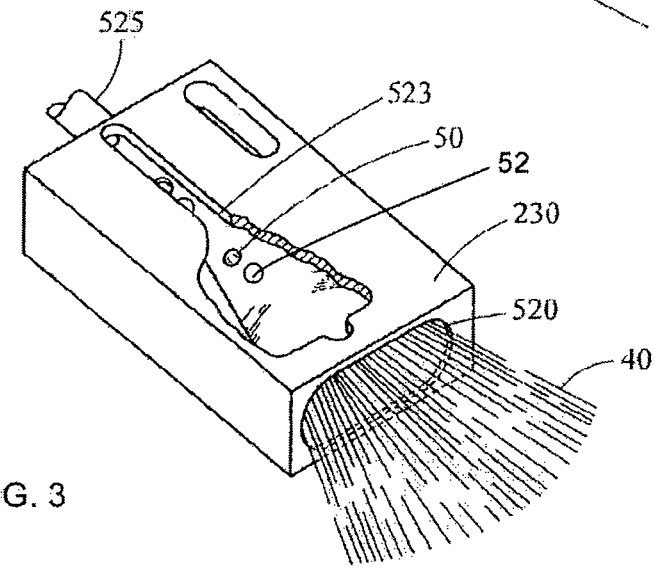
FIG. 3 is a perspective view of a portion of an object insertion unit showing placement of individual first and second objects within a continuous web of filter tow, according to one embodiment of the present invention.
Figure 4A:
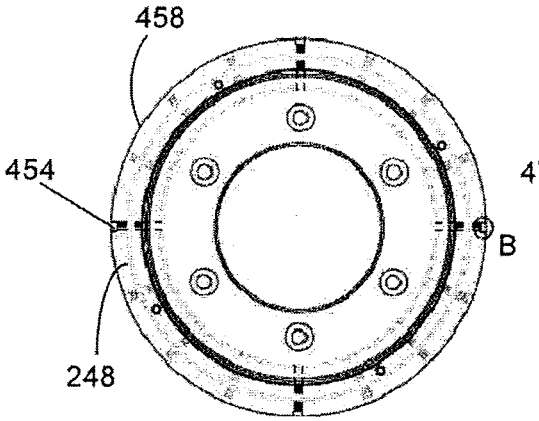
FIGS. 4A-4D are various schematic views of an insertion device having a plurality of pockets, each pocket being configured to receive one or more objects therein, according to one embodiment of the present invention.
Figure 4B:
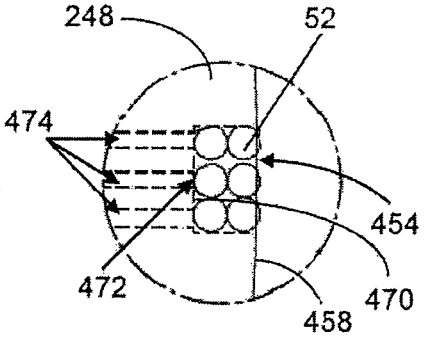
Figure 4C:
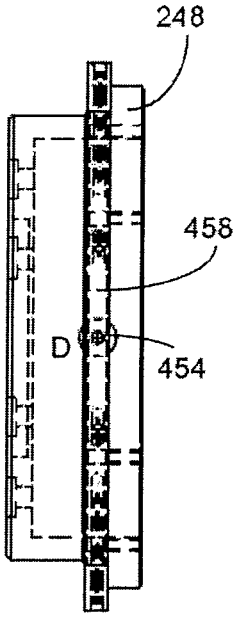
Figure 4D:
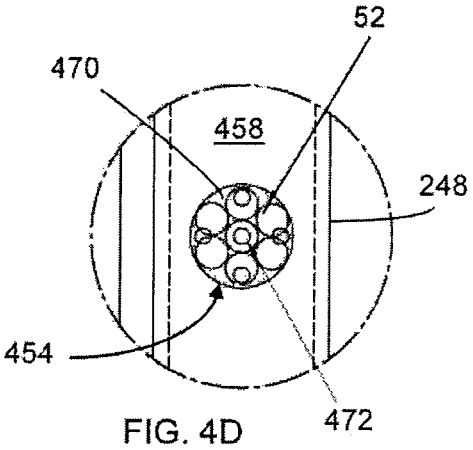
Figure 5A:
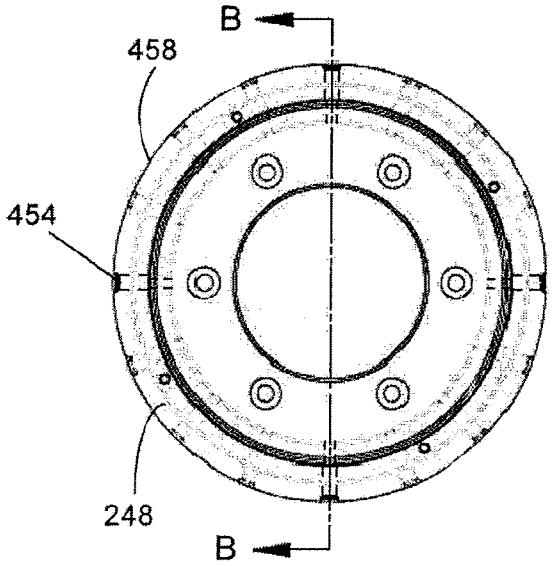
FIGS. 5A-5E are various schematic views of an insertion device having a plurality of pockets, each pocket being configured to receive one or more objects therein, according to an alternate embodiment of the present invention.
Figure 5B:
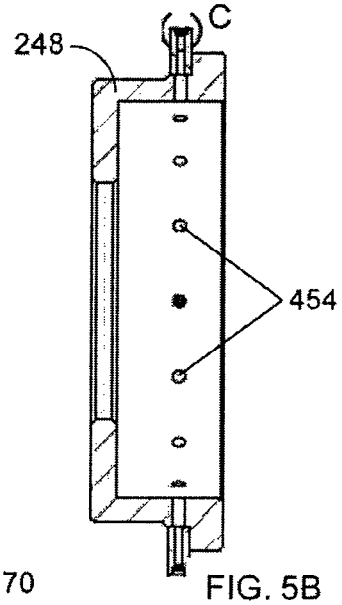
Figure 5C:
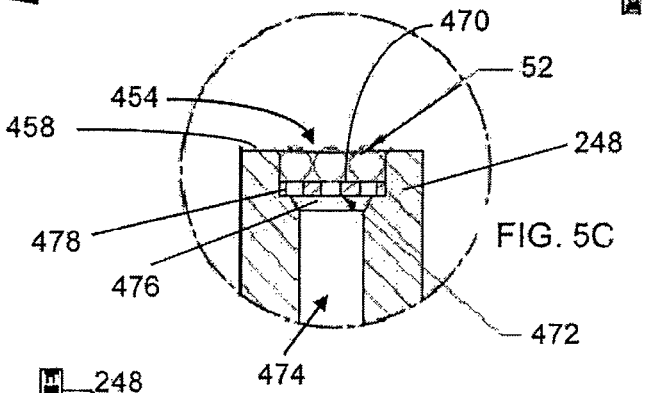
Figure 5D:
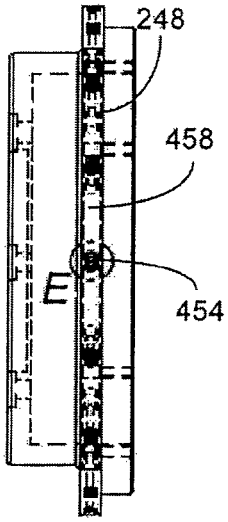
Figure 5E:
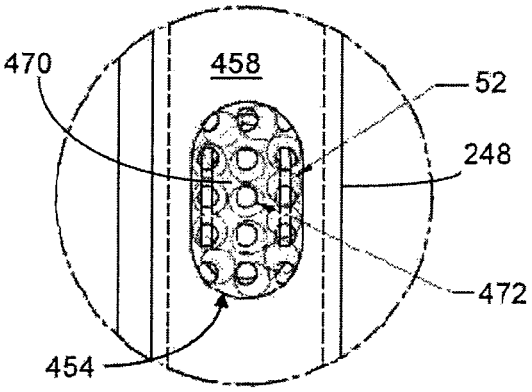

Referring to FIG. 3, the guide or block 230 (the top portion of which is shown as partially cut away) has a relatively wide opening 520 at one end in order that the filter material 40 can be fed therein. The shape of the hollow inner portion of the block 230 may be such that the filter material is formed into a composite, which more generally resembles a cylinder (filter rod 220). In particular, the inner portion of the block 230 may be a hollow region or cavity in order that the filter material 40 can be passed therethrough. The block 230 may have a longitudinally extending slot 523 along the top portion thereof in order to allow the rotating wheel and ledger housing (insertion member 248—not shown) to extend into the web of filter material 40/filter rod 220 and to insert the first and second objects 50, 52 therein. In a suitable situation, a plow (not shown) extends into the slot 523 so as to extend about 0.3 mm to about 0.4 mm from the extreme bottom portion of the hollow inner portion of the block 230. The resulting cylindrical composite 525 is received to further downstream processing regions of the rod-forming unit. Similar types of blocks are set forth, for example, in U.S. Pat. No. 4,862,905 to Green, Jr. et al.

One skilled in the art will also appreciate that the rod-making apparatus 210 may optionally include more than one such block 230 and insertion unit 214 assembly, where such a plurality of assemblies may be, for example, disposed in series. In other instances, a single block 230 may be configured with more than one such insertion unit 214. For example, where each insertion member 248 of the insertion units 214 has a diameter of between about 135 mm and about 140 mm, a pair of insertion members 248 may be mounted with respect to a single block 230 with about 150 mm center-to-center spacing. In instances of more than one insertion device 214 (i.e., more than one block/insertion unit assembly or more than one insertion member per single block), the rod-making apparatus 210 may be configured to place a mixed plurality of first and second objects 50, 52 (i.e., various combinations of first and second objects such as, for example, capsules or pellets, mini-capsules or mini-pellets, or combinations thereof) into the filter material 40/filter rod 220, with each of the object-insertion devices 214 handling or capable of handling various types of objects. In some instances, the block/insertion member assemblies (multiple assemblies) or the insertion members (single block/multiple insertion members) may also be modularly configured or otherwise optional such that the number of object-insertion devices 214 may be varied as necessary or desirable. In order to accomplish the desired configuration of first and second object insertion, the plurality of object-insertion devices 214 may be coordinated and/or synchronized in various manners, such as by timing, sensing, or any other suitable scheme.

Preferred types of first and second objects and the dimensions thereof are set forth below. The objects can vary. Each object may possess a generally spherical shape, and most preferably is highly spherical in nature. Some objects can be generally solid in nature. Some objects can be composed of a plastic material; and each can be, for example, a solid spherical bead composed of a mixture of polyethylene and flavor, or a spherical bead having the form of exchange resin or gel. Some objects can be composed of an inorganic material; and can be for example, a spherical alumina bead. The objects also can each have the form of a spherical bead composed of a carbonaceous material. The objects also can each have the form of a hollow sphere. Typical hollow objects are liquid-containing objects, such as breakable capsules, which are highly spherical, are uniform in size and weight, have surface properties that allow such objects to be processed efficiently and effectively using automated filter making equipment, and are highly uniform in composition. Some objects have diameters of about 3 mm to about 4 mm, preferably about 3.5 mm, and the components of the preferred filter rod-making equipment of the present invention are suitably adapted or designed to efficiently and effectively produce filter rods incorporating those types of objects. Preferred hollow objects have sufficient physical integrity to not rupture during handling and insertion thereof into the filter material.

Other types of objects, beads, capsules and capsule components that can be employed for the production of filter rods using the foregoing filter rod manufacturing techniques and equipment are of the type set forth in U.S. Pat. No. 3,685,521 to Dock; 3,916,914 to Brooks et al.; U.S. Pat. No. 4,889,144 to Tateno et al.; and U.S. Pat. No. 6,631,722 to MacAdam et al.; US Pat. Appl. Pub. No. 2004/0261807 to Dube et al.; and PCT Application Pub. No. WO 03/009711 to Kim; which are incorporated herein by reference. Tobacco products can incorporate those types of components set forth in US Patent Publication Nos. 2006/0272663 to Dube et al., 2006/0130861 to Luan et al., 2006/0144412 to Mishra et al.; and 2007/0012327 to Karles et al.; PCT WO 2006/136197; PCT WO 2006/136199; and PCT WO 2007/010407 PCT WO 2007/060543; and U.S. Pat. No. 7,115,085 to Deal; and 7,479,098 to Thomas et al.; as well as within filtered cigarettes that have been marketed under the tradename "Camel Lights with Menthol Boost" and "Camel Crush" by R. J. Reynolds Tobacco Company. Exemplary pelletized carrier materials and flavor packages are of the type employed in cigarettes that have been marketed commercially in the USA. For example, flavor-carrying pellets have been incorporated into cigarette filters employed on Camel brand cigarettes under the tradenames Mandalay Lime, Mandarin Mint, Breach Breezer, Back Ally Blend, Snakeyes Scotch, Izmir Stinger, Kauai Kolada, Midnight Madness, Aegean Spice, Screwdriver Slots, Twist, Twista Lime, Dark Mint and Blackjack Gin; Kool brand cigarettes under the tradenames Flow and Groove; and Salem brand cigarettes under the tradename Deep Freeze; all of which have been marketed by R. J. Reynolds Tobacco Company.

Figure 7:
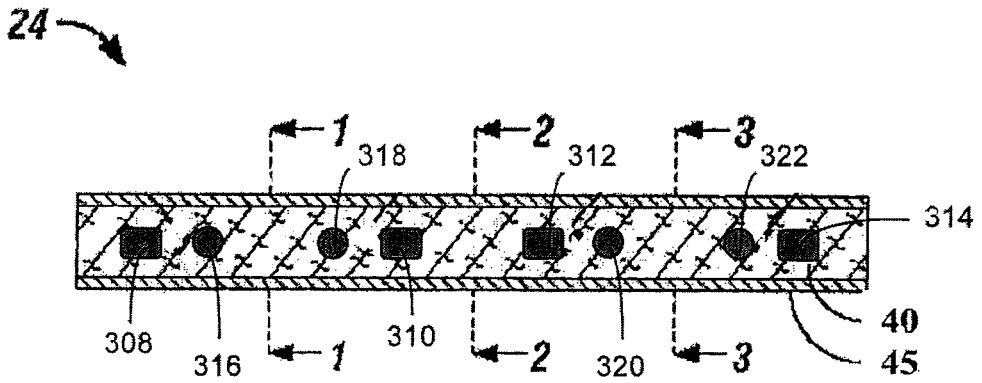
FIG. 7 is a cross-sectional view of a representative filter rod having the first and second objects positioned therein, according to one embodiment of the present invention.

Referring to FIG. 7, a filter rod 24 generally can be further subdivided into individual cylindrical shaped filter elements or rod portions using techniques as are known by the skilled artisan familiar with conventional cigarette manufacturing, and as described above. The filter rod 24 includes filter material 40 encased in circumscribing wrapping material 45 such as conventional air permeable or air impermeable paper plug wrap, or other suitable wrapping material. As an example, at least one first and second object, and preferably a plurality of first objects 308, 310, 312 and 314 and a plurality of second objects 316, 318, 320 and 322 may be disposed along the longitudinal axis of and within the rod 24. As shown, adjacent first objects 310, 312 and adjacent second objects 316, 318 and 320, 322 are relatively spaced apart, while adjacent first and second objects 308, 316; 310, 318; 312, 320; and 314, 322 are relatively close together, wherein the greater spacing may correspond, for example, to a division between successive filter rod portions. One skilled in the art will note that the entire filter rod may include sufficient one or more first and second objects therein such that each filter rod portion includes the same number of one or more first and second objects when the filter rod is subdivided. For example, a four-up filter rod may include first and second objects, each in multiples of four such that, upon subdivision, each filter rod portion may include 1, 2, 3, or 4 of each of the first and second objects.

According to other embodiments of the present invention, as illustrated in FIG. 913, the filter rod 24 may be subdivided using rod cutting assembly 222 into filter rod portions such that each filter rod portion includes or otherwise defines a plurality of integral cigarette filter elements, wherein each cigarette filter element includes at least one first object 50 and at least one second object 52. For example, the filter rod 24 may be initially subdivided along lines 4-4, 5-5, 6-6, and 7-7 into filter rod portions 630, 632, 634, 636, and 638, respectively, as shown in FIG. 9. The filter rod portions may then be further subdivided such as along line 8-8 (FIG. 10) to form a subdivided filter rod portion having or defining only two integral cigarette filter elements such as, for example, subdivided filter rod portions 634*a*, 634*b*, with each having at least one first and second object 50, 52 disposed therein. As shown in FIG. 10, each subdivided filter rod portion 634*a*, 634*b* includes two pairs of first and second objects 50, 52 disposed therein, wherein the first pair has the first and second objects 50, 52 in the reverse order compared to the second pair along the longitudinal axis. The succession or plurality of subdivided filter rod portions may then be collected in a tray, a rotary collection drum, conveying system, or the like. If desired, the subdivided filter rod portions may then be transported directly to a cigarette forming unit configured to attach, secure, or otherwise couple a tobacco rod portion to the individual cigarette filter elements defined thereby. In this regard, each subdivided filter rod portion (i.e., 634*a*) may have a pair of tobacco rod portions attached thereto on opposing ends thereof such that the two individual cigarette filter elements defined thereby have a tobacco rod portion 15 attached thereto (see, e.g., FIG. 11). The tobacco rod portions 15 may be coupled to the ends of the subdivided filter rod portion 634*a* with tipping paper or by other processes as known in the art. As illustrated in FIG. 12, the subdivided filter rod portion 634*a* having the tobacco rod portions 15 attached thereto may then be further subdivided using a cigarette-dividing unit (not shown) such that two as-formed cigarettes are produced (see, e.g., FIG. 13). Due to the particular placement of each of the first and second object 50, 52 within the continuous filter rod, as well as the subsequent subdivision steps, each produced as-formed cigarette has the first and second objects 50, 52 disposed within the cigarette filter element in the same order with respect to the tobacco rod portion 15 thereof.

Figure 8:
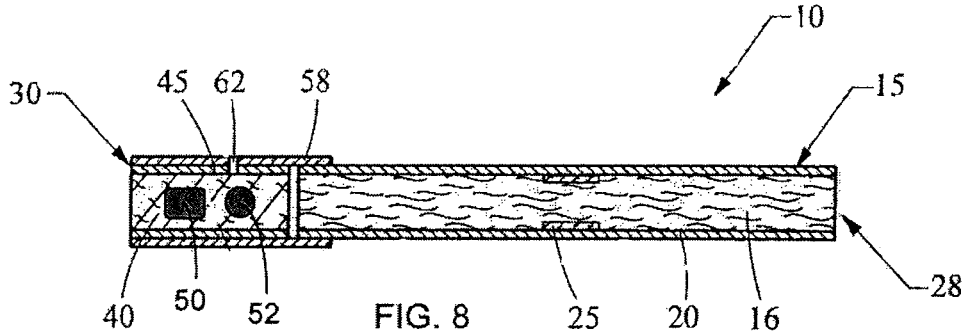
FIG. 8 is a cross-sectional view of a representative smoking article having the form of a cigarette, showing the smokable material, the wrapping material components, and the first and second objects contained in the filter element of that cigarette, according to one embodiment of the present invention.

Referring to FIG. 8, there is shown a smoking article 10, such as a cigarette, possessing certain representative components The cigarette 10 includes a generally cylindrical rod 15 of a charge or roll of smokable filler material 16 contained in a circumscribing wrapping material 20. The rod 15 is conventionally referred to as a "tobacco rod." The ends of the tobacco rod are open to expose the smokable filler material. The cigarette 10 is shown as having one optional band 25 (e.g., a printed coating including a film-forming agent, such as starch, ethylcellulose, or sodium alginate) applied to the wrapping material 20, and that band 25 circumscribes the cigarette rod in a direction transverse to the longitudinal axis of the cigarette. That is, the band 25 provides a cross-directional region relative to the longitudinal axis of the cigarette. The band 25 can be printed on the inner surface of the wrapping material (i.e., facing the smokable filler material) as shown, or less preferably, on the outer surface of the wrapping material. Although the cigarette can possess a wrapping material having one optional band, the cigarette also can possess wrapping material having further optional spaced bands numbering two, three, or more.

The wrapping material 20 of the tobacco rod 15 can have a wide range of compositions and properties. The selection of a particular wrapping material will be readily apparent to those skilled in the art of cigarette design and manufacture. Tobacco rods can have one layer of wrapping material; or tobacco rods can have more than one layer of circumscribing wrapping material, such as is the case for the so-called "double wrap" tobacco rods. Exemplary types of wrapping materials, wrapping material components and treated wrapping materials are described in U.S. Pat. No. 5,220,930 to Gentry; U.S. Pat. No. 7,275,548 to Hancock et al.; and U.S. Pat. No. 7,281,540 to Barnes et al.; and PCT Application Pub. No. WO 2004/057986 to Hancock et al.; and PCT Application Pub. No. WO 2004/047572 to Ashcraft et al.; which are incorporated herein by reference in their entireties.

At one end of the tobacco rod 15 is the lighting end 28, and at the other end is positioned a filter element 30. The filter element 30 positioned adjacent one end of the tobacco rod 15 such that the filter element and tobacco rod are axially aligned in an end-to-end relationship, preferably abutting one another. Filter element 30 may have a generally cylindrical shape, and the diameter thereof may be essentially equal to the diameter of the tobacco rod. The ends of the filter element permit the passage of air and smoke therethrough. The filter element 30 includes filter material 40 (e.g., cellulose acetate tow impregnated with triacetin plasticizer) that is overwrapped along the longitudinally extending surface thereof with circumscribing plug wrap material 45. That is, the filter element 30 is circumscribed along its outer circumference or longitudinal periphery by a layer of plug wrap 45, and each end is open to expose the filter material 40.

Within the filter element 30 is positioned at least one first object 50 and at least one different second object 52 (the first and second objects including, for example, capsules, pellets). The number of each of the first and second objects within each filter element, most preferably is a pre-determined number, and that number can be 1, 2, 3, or more (i.e., at least one). Most preferably, in some embodiments, each filter element contains a single one of each of a first and second object 50, 52 disposed within the filter material 40 of the filter element, in some instances, particularly towards the central region of the filter element. Most preferably, the nature of the filter material 40 is such that the first and second objects 50, 52 are secured or lodged in place within the filter element 30. In some instances, some of the at least one first and/or second objects 50, 52 (or pluralities thereof) may be hollow, such as a breakable capsule, that may carry a payload incorporating a compound that is intended to introduce some change to the nature or character of mainstream smoke drawn through that filter element (e.g., a flavoring agent). That is, the shell of some hollow first and/or second objects 50, 52 may be ruptured at the discretion of the smoker to release the object payload. Alternatively, some first and second objects 50, 52 may be a solid, porous material with a high surface area capable of altering the smoke and/or air drawn through the filter element. Some first and second objects may be a solid material, such as a polyethylene bead, acting as a substrate or matrix support for a flavoring agent. Some preferred first and second objects are capable of releasing the agent at the command of the user. For example, a preferred breakable hollow object containing a liquid payload is resistant to the release of the payload until the time that the smoker applies a purposeful application of physical force sufficient to rupture the hollow object. Typically, a filter material, such as cellulose acetate tow, is generally absorbent of liquid materials of the type that comprise the payload, and hence the released payload components are capable of undergoing wicking (or otherwise experiencing movement or transfer) throughout the filter element. Since at least one first and second object is included in each filter element, the filter element may include combinations of various types of objects, as appropriate or desired.

The filter element 30 is attached to the tobacco rod 15 using tipping material 58 (e.g., essentially air impermeable tipping paper), that circumscribes both the entire length of the filter element 30 and an adjacent region of the tobacco rod 15. The inner surface of the tipping material 58 is fixedly secured to the outer surface of the plug wrap 45 and the outer surface of the wrapping material 20 of the tobacco rod, using a suitable adhesive; and hence, the filter element and the tobacco rod are connected to one another.

The tipping material 58 connecting the filter element 30 to the tobacco rod 15 can have indicia (not shown) printed thereon. For example, a band on the filter end of a cigarette (not shown) can visually indicate to a smoker the general locations or positions of the first and second objects 50, 52 within the filter element 30. These indicia may help the smoker to locate some first and second objects 50, 52 so that they can, for example, be more easily ruptured by squeezing the filter element 30 directly outside the position of any such rupturable object. The indicia on the tipping material 58 may also indicate the nature of the payload carried by each object. For example, the indicia may indicate that the particular payload is a spearmint flavoring by having a particular color, shape, or design. If desired, the inner surface (i.e., the surface facing the plug wrap) of the tipping material can be coated with a material that can act to retard the propensity of rupturable object contents from migration, wicking or bleeding from the filter material 40 into the tipping material, and hence causing what might be perceived as unsightly visible staining of the tipping material. Such a coating can be provided using a suitable film-forming agent (e.g., ethylcellulose, or a so-called lip release coating composition of the type commonly employed for cigarette manufacture).

A ventilated or air diluted smoking article can be provided with an optional air dilution means, such as a series of perforations 62, each of which extend through the tipping material and plug wrap. The optional perforations 62 can be made by various techniques known to those of ordinary skill in the art, such as laser perforation techniques. As these techniques are carried out after insertion of any first and second objects 50, 52 into the filter element 30, care is taken to avoid damaging the objects during the formation of the perforations 62. One way to avoid damage from air dilution techniques, such as those employing laser perforation technologies, involves locating the perforations at a position adjacent to the positions of the first and second objects 50, 52. In such a manner, radiation, heat or physical forces acting upon the filter element during perforation processes do not have such a great propensity to damage the objects. Alternatively, so-called off-line air dilution techniques can be used (e.g., through the use of porous paper plug wrap and pre-perforated tipping paper). The perforated region can be positioned upstream of any object, or the perforated region can be positioned downstream of any object (i.e., towards the extreme mouth-end of the filter element).

The plug wrap 45 can vary. See, for example, U.S. Pat. No. 4,174,719 to Martin. Typically, the plug wrap is a porous or non-porous paper material. Plug wrap materials are commercially available. Exemplary plug wrap papers are available from Schweitzer-Maudit International as Porowrap Plug Wrap 17-M1, 33-M1, 45-M1, 65-M9, 95-M9, 150-M4, 260M4 and 260-M4T. Preferred plug wrap materials are non-porous in nature. Non-porous plug wraps exhibit porosities of less than about 10 CORESTA units, and preferably less than about 5 CORESTA units. Exemplary non-porous plug wrap papers are available as Ref. No. 646 Grade from Olsany Facility (OP Paprina) of the Czech Republic (Trierendberg Holding). Plug wrap paper can be coated, particularly on the surface that faces the filter material, with a layer of a film-forming material. Such a coating can be provided using a suitable polymeric film-forming agent (e.g., ethylcellulose, ethylcellulose mixed with calcium carbonate, or a so-called lip release coating composition of the type commonly employed for cigarette manufacture). Alternatively, a plastic film (e.g., a polypropylene film) can be used as a plug wrap material. For example, non-porous polypropylene materials that are available as ZNA20 and ZNA-25 from Treofan Germany GmbH & Co. KG can be employed as plug wrap materials.

The use of non-porous plug wrap materials is desirable in order to avoid the contents of rupturable objects within filter elements from causing what might be perceived as unsightly visible staining of the tipping material 58. For example, highly non-porous plug wrap materials can act to retard or block the propensity of liquid contents of the rupturable objects from migration, wicking or bleeding from the filter material 40 into the tipping material. The plug wrap is typically applied about the rod in a garniture region, downstream of the gathering region.

Tobacco materials 16 useful for carrying out the present invention can vary. Tobacco materials can be derived from various types of tobacco, such as flue-cured tobacco, burley tobacco, Oriental tobacco or Maryland tobacco, dark tobacco, dark-fired tobacco and *Rustica* tobaccos, as well as other rare or specialty tobaccos, or blends thereof. Descriptions of various types of tobaccos, growing practices, harvesting practices and curing practices are set for in *Tobacco Production, Chemistry and Technology*, Davis et al. (Eds.) (1999). Most preferably, the tobaccos are those that have been appropriately cured and aged.

Typically, tobacco materials for cigarette manufacture are used in a so called "blended" form. For example, certain popular tobacco blends, commonly referred to as "American blends," comprise mixtures of flue-cured tobacco, burley tobacco and Oriental tobacco. Such blends, in many cases, contain tobacco materials that have a processed form, such as processed tobacco stems (e.g., cut-rolled or cut-puffed stems), volume expanded tobacco (e.g., puffed tobacco, such as dry ice expanded tobacco (DIET), preferably in cut filler form). Tobacco materials also can have the form of reconstituted tobaccos (e.g., reconstituted tobaccos manufactured using paper-making type or cast sheet type processes). The precise amount of each type of tobacco within a tobacco blend used for the manufacture of a particular cigarette brand varies from brand to brand. See, for example, *Tobacco Encyclopedia*, Voges (Ed.) p. 44-45 (1984), Browne, *The Design of Cigarettes,* 3rd Ed., p. 43 (1990) and *Tobacco Production, Chemistry and Technology*, Davis et al. (Eds.) p. 346 (1999). Other representative tobacco types and types of tobacco blends also are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 7,205,066 to Lawson et al.; and U.S. Pat. No. 7,240,678 to Crooks et al.; US Pat. Application Pub. Nos. 2004/0255965 to Perfetti et al; 2004/0261807 to Dube et al.; and 2005/0066986 to Nestor et al.; PCT Application Pub. No. WO 02/37990; and Bombick et al., *Fund. Appl. Toxicol.,* 39, p. 11-17 (1997).

Tobacco materials typically are used in forms, and in manners, that are traditional for the manufacture of smoking articles, such as cigarettes. The tobacco normally is used in cut filler form (e.g., shreds or strands of tobacco filler cut into widths of about 1/10 inch to about 1/60 inch, preferably about 1/20 inch to about 1/35 inch, and in lengths of about 1/4 inch to about 3 inches). The amount of tobacco filler normally used within the tobacco rod of a cigarette ranges from about 0.6 g to about 1 g. The tobacco filler normally is employed so as to fill the tobacco rod at a packing density of about 100 mg/cm3 to about 300 mg/cm3, and often about 150 mg/cm3 to about 275 mg/cm3.

If desired, the tobacco materials of the tobacco rod can further include other components. Other components include casing materials (e.g., sugars, glycerin, cocoa and licorice) and top dressing materials (e.g., flavoring materials, such as menthol). The selection of particular casing and top dressing components is dependent upon factors such as the sensory characteristics that are desired, and the selection of those components will be readily apparent to those skilled in the art of cigarette design and manufacture. See, Gutcho, *Tobacco Flavoring Substances and Methods*, Noyes Data Corp. (1972) and Leffingwell et al., *Tobacco Flavoring for Smoking Products* (1972). The dimensions of a representative cigarette 10 can vary. Preferred cigarettes are rod shaped, and can have diameters of about 7.5 mm (e.g., circumferences of about 22.5 mm to about 25 mm); and can have total lengths of about 80 mm to about 100 mm. The length of the filter element 30 can vary. Typical filter elements can have lengths of about 20 mm to about 40 mm. In one preferred embodiment, the length of the filter element 30 is about 27 mm, and the length of the tobacco rod 15 is about 56 mm to about 57 mm. In another embodiment, the length of the filter element is about 31 mm, and the length of the tobacco rod is about 67 mm to about 68 mm. The tipping paper 58 can circumscribe the entire filter element and about 4 mm of the length of the tobacco rod in the region adjacent to the filter element.

Preferred cigarettes made according to the method of the present invention exhibit desirable resistance to draw, whether or not any hollow objects within their filter elements are broken. For example, an exemplary cigarette exhibits a pressure drop of between about 50 mm and about 200 mm water pressure drop at 17.5 cc/sec. air flow. Preferred cigarettes exhibit pressure drop values of between about 70 mm and about 180 mm, more preferably between about 80 mm to about 150 mm water pressure drop at 17.5 cc/sec. air flow. Typically, pressure drop values of cigarettes are measured using a Filtrona Filter Test Station (CTS Series) available form Filtrona Instruments and Automation Ltd.

In use, the smoker lights the lighting end 28 of the cigarette 10 and draws smoke into his/her mouth through the filter element 30 at the opposite end of the cigarette. The smoker can smoke all or a portion of the cigarette with the first and second objects 50, 52 intact. During the portion of the smoking experience that any objects 50, 52 remain intact, smoke generated in the tobacco rod 15 is drawn to the smoker through the filter material 40 of the filter element. Most preferably, the overall character or nature of the drawn smoke is virtually unaffected to any significant degree as a result of the presence of the intact object(s) within the filter element, unless particular objects are configured to be activated by or otherwise affect the drawn smoke. If desired, the smoker may rupture any or all of the rupturable first and/or second objects 50, 52 at any time before, during, or even after, the smoking experience. Breakage of any rupturable object acts to release the contents that are contained and sealed therewithin. Release of the contents of any rupturable object into the filter element thus enables the smoker to achieve the intended benefit of action of certain of those contents, whether that benefit results from flavoring or scenting the smoke, cooling or moistening the smoke, freshening the scent of the cigarette butt, or achieving some other goal associated with modifying the overall composition of the smoke or altering the performance characteristics of the cigarette. That is, in highly preferred embodiments, the contents of any rupturable object are not released into the filter element until the particular object is purposefully physically broken; but when a rupturable object is ruptured, a portion of component contained within the rupturable object (e.g., portions of a flavoring agent) that is consequently released into the filter element is incorporated into each subsequent puff of mainstream smoke that is received through that filter element. In this manner, any rupturable object can be ruptured by the smoker at their discretion. Multiple flavors or scents in or otherwise associated with the individual objects allows for different taste in each puff of the cigarette, or an increased amplitude of sensory response in each puff may be experienced by the smoker, if the flavor is the same in all objects. In some instances, relatively small objects may be incorporated in each filter element, due to the different manners in, and the different extent to, which the sensory responses may be affected when smoking the cigarette.

During use of the cigarette, application of physical pressure to any of the rupturable first and/or second objects 50, 52, for example by a squeezing action provided by the fingers of the smoker to the filter element 30, causes relevant region of the filter element to deform and hence causes a particular rupturable object or objects to rupture and release the respective payload to the filter material 40 of the filter element. The rupture of any rupturable first and/or second object 50, 52 can be discerned by an audible pop or snap, the feel of a crushing or shattering of the rupturable object, or the sense of a rapid decrease in the resistance to the pressure applied by the smoker. Rupture of a rupturable object causes contents of its payload to disperse throughout portions of the filter material 40, and potentially to some extent into the tobacco rod 15. Most preferably, the filter element into which the first and second objects are placed and maintained is such that the filter element effectively maintains its overall shape during the manufacture, storage and use of the cigarette. Most preferably, the filter element is sufficiently flexible such that the overall cylindrical shape of the filter element returns to essentially its original shape after the application of pressure to the filter element is ceased. That is, the filter element possesses sufficient flexibility to allow squeezing pressure applied by the fingers of the smoker to break a rupturable object, and sufficient resilience to allow the deformed filter element to return to its original shape.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of forming a rod for use in the manufacture of cigarette filter elements, the rod having a length and defining a longitudinal axis, the method comprising:

forming a continuous supply of filter material into a continuous filter rod;

subdividing the continuous filter rod, at predetermined intervals along the longitudinal axis, into a plurality of filter rod portions;

delivering a plurality of first and second objects respectively via first and second rotatable feeders to a rotatable insertion member; and inserting the first and second objects into the filter material forming the continuous filter rod and at a selected depth within the filter material relative to the longitudinal axis via the rotatable insertion member, the first objects being different from the second objects, the first and second objects being inserted into the filter material forming the filter rod such that each filter rod portion of the subdivided filter rod includes at least one first object and at least one second object disposed within the filter material thereof.

2. A method according to claim 1 wherein inserting the first and second objects further comprises inserting the first and second objects into the filter material forming the continuous filter rod in serially-disposed groups, each successive group having the first and second objects alternatingly disposed along the longitudinal axis with respect to the previous group.

3. A method according to claim 2 wherein subdividing the continuous rod further comprises initially subdividing the continuous filter rod along the longitudinal axis into a plurality of filter rod portions such that each filter rod portion includes at least two serially-disposed groups of first and second objects disposed within the filter material thereof, each successive group having the first and second objects alternatingly disposed along the longitudinal axis with respect to the previous group.

4. A method according to claim 3 further comprising subdividing each filter rod portion, as necessary, such that each subdivided filter rod portion includes only two serially-disposed groups of first and second objects disposed within the filter material thereof, with one group having the first and second objects oppositely disposed along the longitudinal axis with respect to the other group.

5. A method according to claim 4 further comprising coupling a tobacco rod portion to each opposing end of each subdivided filter rod portion.

6. A method according to claim 5 further comprising subdividing the filter rod portion having the tobacco rod portions coupled thereto, between the two groups of first and second objects disposed within the filter material thereof along the longitudinal axis, to form individual cigarettes, each cigarette having the first and second objects similarly disposed within the filter material of the filter rod portion thereof with respect to the tobacco rod portion.

7. A method according to claim 1 wherein inserting the first and second objects further comprises ejecting the first and second objects from the rotatable insertion member into the filter material forming the continuous filter rod.

8. A method according to claim 1 wherein inserting the first and second objects further comprises:

rotating the rotatable insertion member about a first axis;

receiving the first and second objects from the respective first and second rotatable feeders into a plurality of pockets defined by a peripheral surface of the rotatable insertion member, the peripheral surface extending parallel to the first axis;

applying a negative pressure to at least a portion of the pockets so as to maintain the respective first and second objects within the pockets during rotation of the rotatable insertion member.

9. A method according to claim 8 wherein receiving the first and second objects further comprises receiving the first and second objects in serially-disposed groups from the respective first and second rotatable feeders, such that each successive group has the first and second objects alternatingly disposed about the peripheral surface with respect to the previous group.

10. A method according to claim 8 further comprising preventing the one of the first and second objects disposed in each pocket of the insertion member from being drawn radially inward through the pocket by the negative pressure with a retaining member associated with each pocket.

11. A method according to claim 1 wherein delivering the first and second objects further comprises:

transferring the first and second objects in the first and second hopper assemblies respectively into a series of pockets defined in the first and second rotatable feeders; and transferring the one of the first and second objects from the respective first and second rotatable feeders to the rotatable insertion member.

12. A method according to claim 11 wherein transferring the one of the first and second objects to the rotatable insertion member further comprises ejecting the one of the first and second objects from the pockets of the first and second rotatable feeders into corresponding pockets defined by the rotatable insertion member.

* * * * *